US011410511B2

(12) United States Patent
Bodurka et al.

(10) Patent No.: US 11,410,511 B2
(45) **Date of Patent: *Aug. 9, 2022**

(54) PATIENT SUPPORT APPARATUSES WITH NURSE CALL AUDIO MANAGEMENT

(71) Applicant: Stryker Corporation, Kalamazoo, MI (US)

(72) Inventors: Alexander Josef Bodurka, Portage, MI (US); Krishna Sandeep Bhimavarapu, Kalamazoo, MI (US); Jerald A. Trepanier, Kalamazoo, MI (US); Thomas Allen Deeds, Northville, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,564

(22) Filed: Aug. 31, 2021

(65) Prior Publication Data

US 2021/0398404 A1 Dec. 23, 2021

Related U.S. Application Data

(63) Continuation of application No. 16/847,753, filed on Apr. 14, 2020, now Pat. No. 11,113,935.

(60) Provisional application No. 62/833,943, filed on Apr. 15, 2019.

(51) Int. Cl.
*G08B 7/06* (2006.01)
*H04R 3/00* (2006.01)

(52) U.S. Cl.
CPC ..... *G08B 7/06* (2013.01); *H04R 3/00* (2013.01)

(58) Field of Classification Search
CPC . A61B 5/202; A61F 2013/424; A61G 12/001; A61G 7/005; B01D 53/14; F24F 3/1423; G06K 7/10366
See application file for complete search history.

(56) References Cited

U.S. PATENT DOCUMENTS 5,335,313 A * 8/1994 Douglas ..... G10L 15/26 704/E15.045
8,272,892 B2 * 9/2012 McNeely ..... A61G 7/012 600/595
9,830,424 B2 * 11/2017 Dixon ..... G16H 40/67
10,652,971 B2 * 5/2020 Wilkolaski ..... H05B 41/38
(Continued)

*Primary Examiner* — Curtis J King
(74) *Attorney, Agent, or Firm* — Warner Norcross + Judd LLP

(57) ABSTRACT

A patient support apparatus includes a frame, a support surface for supporting a patient, and a nurse call interface adapted to provide an interface between a bed and a wall-mounted nurse call outlet having a plurality of pins to thereby allow a patient supported on the bed to communicate with a remotely positioned nurse. The nurse call interface coordinates the duplex signals of the bed's microphone and speaker with the half duplex nurse audio signals from the nurse call system. More particularly, the interface includes a nurse call audio channel communicatively coupled to first and second audio pins of the plurality of pins of the nurse call outlet, a bed microphone channel to a bed microphone, a bed speaker channel to a bed speaker, and a switch controller adapted to selectively connect the nurse call audio channel to the bed microphone channel or to the bed speaker channel.

20 Claims, 10 Drawing Sheets

(56) References Cited

U.S. PATENT DOCUMENTS

2003/0043302 A1* 3/2003 Stoner ..... H04N 5/63 348/E5.103
2003/0194910 A1* 10/2003 Stoner ..... H01R 31/06 439/638
2004/0193449 A1* 9/2004 Wildman ..... G16H 40/67 705/2
2006/0049936 A1* 3/2006 Collins, Jr. ..... G08B 21/028 340/539.11
2007/0004971 A1* 1/2007 Riley ..... A61B 5/0022 600/300
2007/0040692 A1* 2/2007 Smith ..... A61B 5/1115 340/573.1
2007/0157385 A1* 7/2007 Lemire ..... A61G 7/08 5/618
2007/0210917 A1* 9/2007 Collins, Jr. ..... G07C 3/00 340/539.1
2008/0205310 A1* 8/2008 Perkins ..... H04W 72/1231 370/310
2008/0205311 A1* 8/2008 Perkins ..... A61B 5/6887 370/310
2012/0075464 A1* 3/2012 Derenne ..... A61B 5/0036 600/595
2013/0135160 A1* 5/2013 Dixon ..... H04B 5/0056 343/720
2013/0318716 A1* 12/2013 Vanderpohl, III ..... A61G 7/015 5/600
2015/0243162 A1* 8/2015 Daum ..... H04N 21/42206 340/286.07
2016/0038361 A1* 2/2016 Bhimavarapu ..... H04B 7/24 398/115
2016/0307429 A1* 10/2016 Hood ..... A61B 5/1115
2017/0323555 A1* 11/2017 Embree ..... G16H 40/63
2018/0369035 A1* 12/2018 Bhimavarapu ..... A61G 7/018

* cited by examiner

| | |
|---|---|
| Pin 1 | Bed Monitoring Status On |
| Pin 2 | Read Light |
| Pin 3 | Room Light |
| Pin 4 | Speaker High |
| Pin 5 | Potentiometer Wiper |
| Pin 6 | Bed Exit Status On |
| Pin 7 | Nurse Call Interlock |
| Pin 8 | Audio Transfer - |
| Pin 9 | Audio Transfer + |
| Pin 10 | Interlock + |
| Pin 11 | Interlock - |
| Pin 12 | Bed Monitoring Fowler 30 deg. Alert |
| Pin 13 | No Connect |
| Pin 14 | Potentiometer Low Common |
| Pin 15 | Potentiometer High Common (Std.) / Audio (STV) |
| Pin 16 | Nurse Answer Light + |
| Pin 17 | Bed Monitor Alert |
| Pin 18 | Bed Monitoring Siderail Alert |
| Pin 19 | Nurse Call Light + |
| Pin 20 | No Connect |
| Pin 21 | No Connect |
| Pin 22 | No Connect |
| Pin 23 | Brake Status On |
| Pin 24 | No Connect |
| Pin 25 | Nurse Call + |
| Pin 26 | Nurse Call NO/NC |
| Pin 27 | Room/Read Light Common |
| Pin 28 | Nurse Call Light - |
| Pin 29 | Nurse Answer Light - |
| Pin 30 | Priority NO/NC |
| Pin 31 | Priority Common |
| Pin 32 | Bed Monitoring Low Height Alert |
| Pin 33 | TV - (Std.) / Data (STV) |
| Pin 34 | TV + (Std.) / Common (STV) |
| Pin 35 | Speaker Low Common |
| Pin 36 | Audio Shield |
| Pin 37 | Bed Monitoring Common |

FIG. 12
(Prior Art)

PATIENT SUPPORT APPARATUSES WITH NURSE CALL AUDIO MANAGEMENT

CROSS-REFERENCE TO RELATED APPLICATIONS

This application claims priority to U.S. patent application Ser. No. 16/847,753 filed Apr. 14, 2020, by inventors Alexander Bodurka et al. and entitled PATIENT SUPPORT APPARATUSES WITH NURSE CALL AUDIO MANAGEMENT, which in turn claims priority to U.S. provisional patent application Ser. No. 62/833,943 filed Apr. 15, 2019, by inventors Alexander Bodurka et al. and entitled PATIENT SUPPORT APPARATUSES WITH NURSE CALL AUDIO MANAGEMENT, the complete disclosures of both of which are incorporated herein by reference.

BACKGROUND

The present disclosure relates to patient support apparatuses, such as beds, cots, stretchers, recliners, or the like. More specifically, the present disclosure relates to patient support apparatuses that are adapted to communicate with an existing nurse call system and/or one or more room controls.

Existing hospital beds often include an exit detection system that detects when the patient leaves the bed and notifies a nurse call system that the patient has left the bed. Existing hospital beds also often include a nurse call button and a speaker that together allow the patient to communicate with a remote nurse using the nurse call system. Still other features and/or information regarding the bed may also be communicated to and/or through the nurse call system, or to a room interface board that controls various aspects of the room in which the patient support apparatus is positioned (e.g. volume, channel, and power of a television, room temperature, room lights, etc.)

In many nurse call systems, the audio communication channel between the bed and the nurse call system is a half duplex communication channel. In such situations, the bed often includes a speaker that functions as both a speaker and a microphone, and the nurse call system controls when the speaker is emitting sounds for the patient to hear and when the speaker is acting as a microphone to transmit sounds to the remotely positioned nurse. The nurse call system is thereby able to control which direction audio signals are communicated over the half duplex communication channel.

Further, in many nurse call systems, the audio connection between the bed and the nurse call system is often additionally used for transmitting sounds from a nearby television to the speaker onboard the bed. In such systems, the nurse call system controls a switch (positioned off-board the bed, such as on the room interface board) that switches between transmitting nurse audio signals over the audio communication channel to the bed and transmitting television audio signals over the audio communication channel to the bed. Control of both the directionality of the half-duplex nurse call audio channel, as well as the content of the audio (TV versus nurse call audio) therefore typically resides with the nurse call system, and such control complicates the design of products, such as beds, that interface with the nurse call system.

SUMMARY

According to various embodiments, the present disclosure provides one or more improved features for interfacing a patient support apparatus to a conventional nurse call system. In at least one embodiment, the present disclosure enables a patient support apparatus to include both a separate microphone and a separate speaker and to control when the speaker is coupled to the half duplex nurse call audio channel of the nurse call system and when the microphone is coupled to the half duplex nurse call audio channel of the nurse call system. The system, in some embodiments, also facilitates and eases the design of a wireless interface between the patient support apparatus wherein the wireless interface may be coupled by wires to the nurse call interface and communicate with the patient support apparatus wirelessly. In still other embodiments, the nurse call interface may be incorporated into the patient support apparatus, or into an intermediate device that plugs into one end of a nurse call cable that extends between the patient support apparatus and the nurse call outlet.

According to one embodiment of the present disclosure, a bed is provided that includes a litter frame, a support deck, a lift system, a speaker, a microphone, and a nurse call interface. The support deck is supported by the litter frame and is adapted to support a patient thereon. The lift system is adapted to change a height of the litter frame relative to a floor on which the bed is positioned. The nurse call interface is adapted to interface between the bed and a wall-mounted nurse call outlet having a plurality of pins. The nurse call interface is further adapted allow a patient supported on the support deck to communicate with a remotely positioned nurse. The nurse call interface includes the following: a nurse call audio channel communicatively coupled to first and second audio pins of the plurality of pins of the nurse call outlet; a bed microphone channel communicatively coupled to the microphone; a bed speaker channel communicatively coupled to the speaker; a switch adapted to switch between a first state in which the nurse call audio channel is communicatively coupled to the bed microphone channel and a second state in which the nurse call audio channel is communicatively coupled to the bed speaker channel; and a switch controller adapted to control when the switch is in the first state and when the switch is in the second state.

According to other aspects of the present disclosure, the switch controller may include a nurse call light input that is adapted to communicate with a nurse call light pin from the plurality of pins of the nurse call outlet. In such embodiments, the switch controller uses a signal from the nurse call light input to control when to put the switch in the first state or the second state.

In some embodiments, the switch controller also, or alternatively, includes a nurse call answer light input that is adapted to communicate with a nurse call answer light pin from the plurality of pins of the nurse call outlet. In such embodiments, the switch controller uses a signal from the nurse call answer light input to control when to put the switch in the first state or the second state.

The bed, in some embodiments, further includes a talk switch adapted to be activated by the patient when the patient wishes to talk to the remotely positioned nurse. In such embodiments, the talk switch communicates with the switch controller and the switch controller uses a signal from the talk switch to control when to put the switch in the first state or the second state. The talk switch may be a button adapted to be pressed when the patient wishes to talk to the remotely positioned nurse, or it may take on other forms.

In some embodiments, the switch controller is adapted to analyze a signal on the bed microphone channel and to use the analysis of the signal to control when to put the switch in the first state or the second state. The analysis may include echo cancellation to remove any component of the signal due to sounds emitted from the speaker and captured by the microphone. The analysis may also, or alternatively, include detecting an audio signal from the patient, in which case the switch controller is adapted to change the switch to the first state if the switch controller detects the audio signal from the patient on the bed microphone channel. The switch controller may also change the switch to the second state if the switch controller does not detect an audio signal from the patient on the bed microphone channel.

In some embodiments, the switch controller is adapted to analyze a signal on the nurse call audio channel and to use the analysis of the signal to control when to put the switch in the first state or the second state. The switch controller may also, or alternatively, include a television audio detector in communication with the nurse call audio channel that is adapted to distinguish between television audio signals and nurse call audio signals that are present on the nurse call audio channel. The television audio signals come from a television and the nurse call audio signals come from a nurse call microphone positioned adjacent the remotely positioned nurse. In such embodiments, the audio detector may be adapted to distinguish between the television audio signals and the nurse call audio signals that are present on the nurse call audio channel by sending a mute signal to the television and monitoring any change in signals present on the nurse call audio channel.

In some embodiments, the switch controller is adapted to set the switch to the first state when the switch controller detects a patient voice signal on the bed microphone channel to thereby add the patient voice signal on the bed microphone channel to the nurse call audio channel.

In some embodiments, the nurse call interface further includes a first audio detector adapted to detect a first audio signal on the nurse call audio channel and a second audio detector adapted to detect a second audio signal on the bed microphone channel. The switch controller uses a first signal from the first audio detector and a second signal from the second audio detector to control when to put the switch in the first state or the second state. The switch controller may be further configured to set the switch to the first state when both the first audio detector detects the first audio signal on the nurse call audio channel and the second audio detector detects the second audio signal on the bed microphone channel.

Alternatively, the switch controller may be further configured to set the switch to the second state when both the first audio detector detects the first audio signal on the nurse call audio channel and the second audio detector detects the second audio signal on the bed microphone channel.

In some embodiments, the bed further comprises a second microphone coupled to the switch controller, wherein the switch controller is adapted to use signals from the second microphone to control when to put the switch in the first state or the second state.

The switch, in some embodiments, is integrated into a microcontroller adapted to execute a set of instructions. The set of instructions cause the microcontroller, when executed, to analyze signals on the bed microphone channel and the nurse call audio channel and to use the analysis to control when to put the switch in the first state or the second state.

The switch controller is further adapted to perform the following, in some embodiments: (a) monitor a state of a particular pin from the plurality of pins during an installation test in which the remotely positioned nurse transmits an audio signal to the nurse call audio channel, the particular pin being different from both the first and second audio pins; and (b) if the particular pin changes state during the installation test, to use the state of the particular pin subsequent to the installation test to control when the switch is in the first state and when the switch is in the second state; and (c) if the particular pin does not change state during the installation test, to not use the state of the particular pin subsequent to the installation test to control when the switch is in the first state and when the switch is in the second state. In some embodiments, the particular pin is a nurse call answer light pin.

The switch controller, in some embodiments, is further adapted to monitor a state of a second particular pin during the installation test and, if the state of the second particular pin changes state during the installation test, to use the state of the second particular pin to control when the switch is in the first state and when the switch is in the second state, and if the second particular pin does not change state during the installation test, to not use the state of the second particular pin to control when the switch is in the first state and when the switch is in the second state. The second particular pin may be an audio transfer pin.

In some embodiments, the switch controller is further adapted to perform the following: (a) analyze signals on the nurse call audio channel during an installation test, wherein the installation test comprises a first phase in which first audio signals from a television are supplied to the nurse call audio channel and a second phase in which second audio signals from a remotely positioned nurse are supplied to the nurse call audio channel; (b) attempt to identify a distinguishing characteristic between the first and second audio signals; and (c) if a distinguishing characteristic is identified, to use the distinguishing characteristic subsequent to the installation test to control when the switch is in the first state and when the switch is in the second state.

According to another embodiment of the present disclosure, a wireless nurse call interface is provided that is adapted to be mounted to a wall and to provide an interface between a bed and a wall-mounted nurse call outlet having a plurality of pins. The wireless nurse call interface thereby allows a patient supported on the bed to communicate with a remotely positioned nurse. The wireless nurse call interface comprises a nurse call audio channel, a bed microphone channel, a bed speaker channel, a switch, and a switch controller. The nurse call audio channel is communicatively coupled to first and second audio pins of the plurality of pins of the nurse call outlet. The bed microphone channel is communicatively coupled to a wireless receiver that is adapted to receive audio signals from the bed that are generated by an onboard microphone. The bed speaker channel is communicatively coupled to a wireless transmitter that is adapted to transmit audio signals to the bed to be communicated to an onboard speaker. The switch is adapted to switch between a first state in which the nurse call audio channel is communicatively coupled to the bed microphone channel and a second state in which the nurse call audio channel is communicatively coupled to the bed speaker channel. The switch controller is adapted to control when the switch is in the first state and when the switch is in the second state.

According to other aspects of the present disclosure, the switch controller includes a nurse call light input that is adapted to communicate with a nurse call light pin from the plurality of pins of the nurse call outlet. The switch controller uses a signal from the nurse call light input to control when to put the switch in the first state or the second state.

The switch controller may alternatively, or additionally, include a nurse call answer light input that is adapted to communicate with a nurse call answer light pin from the plurality of pins of the nurse call outlet. The switch controller uses a signal from the nurse call answer light input to control when to put the switch in the first state or the second state.

In some embodiments, the wireless nurse call interface is further adapted to receive a wireless signal from a talk switch coupled to the bed. The talk switch is adapted to be activated by the patient when the patient wishes to talk to the remotely positioned nurse, and the switch controller uses the wireless signal from the talk switch to control when to put the switch in the first state or the second state. The talk switch may be a button adapted to be pressed by the patient when he or she wishes to talk to the remotely positioned nurse.

In some embodiments, the switch controller is adapted to analyze a signal on the bed microphone channel and to use the analysis of the signal to control when to put the switch in the first state or the second state. The analysis may include echo cancellation to remove any component of the signal due to sounds emitted from the speaker and captured by the microphone. The analysis may also, or alternatively, include detecting an audio signal from the patient, in which case the switch controller is adapted to change the switch to the first state if the switch controller detects the audio signal from the patient on the bed microphone channel. The switch controller may also change the switch to the second state if the switch controller does not detect an audio signal from the patient on the bed microphone channel.

In some embodiments, the switch controller is adapted to analyze a signal on the nurse call audio channel and to use the analysis of the signal to control when to put the switch in the first state or the second state. The switch controller may also, or alternatively, include a television audio detector in communication with the nurse call audio channel that is adapted to distinguish between television audio signals and nurse call audio signals that are present on the nurse call audio channel. The television audio signals come from a television and the nurse call audio signals come from a nurse call microphone positioned adjacent the remotely positioned nurse. In such embodiments, the audio detector may be adapted to distinguish between the television audio signals and the nurse call audio signals that are present on the nurse call audio channel by sending a mute signal to the television and monitoring any change in signals present on the nurse call audio channel.

In some embodiments, the switch controller is adapted to set the switch to the first state when the switch controller detects a patient voice signal on the bed microphone channel to thereby add the patient voice signal on the bed microphone channel to the nurse call audio channel.

In some embodiments, the nurse call interface further includes a first audio detector adapted to detect a first audio signal on the nurse call audio channel and a second audio detector adapted to detect a second audio signal on the bed microphone channel. The switch controller uses a first signal from the first audio detector and a second signal from the second audio detector to control when to put the switch in the first state or the second state. The switch controller may be further configured to set the switch to the first state when both the first audio detector detects the first audio signal on the nurse call audio channel and the second audio detector detects the second audio signal on the bed microphone channel.

Alternatively, the switch controller may be further configured to set the switch to the second state when both the first audio detector detects the first audio signal on the nurse call audio channel and the second audio detector detects the second audio signal on the bed microphone channel.

In some embodiments, the wireless nurse call interface is adapted to receive signals from a second microphone onboard the bed and the switch controller is adapted to use signals from the second microphone to control when to put the switch in the first state or the second state.

The switch, in some embodiments, is integrated into a microcontroller adapted to execute a set of instructions. The set of instructions cause the microcontroller, when executed, to analyze signals on the bed microphone channel and the nurse call audio channel and to use the analysis to control when to put the switch in the first state or the second state.

The wireless nurse call interface, in some embodiments, is constructed such that the wireless receiver and the wireless transmitter are integrated together into a Bluetooth transceiver.

The switch controller is adapted to perform the following, in some embodiments: (a) monitor a state of a particular pin from the plurality of pins during an installation test in which the remotely positioned nurse transmits an audio signal to the nurse call audio channel, the particular pin being different from both the first and second audio pins; and (b) if the particular pin changes state during the installation test, to use the state of the particular pin subsequent to the installation test to control when the switch is in the first state and when the switch is in the second state; and (c) if the particular pin does not change state during the installation test, to not use the state of the particular pin subsequent to the installation test to control when the switch is in the first state and when the switch is in the second state. In some embodiments, the particular pin is a nurse call answer light pin.

The switch controller, in some embodiments, is adapted to monitor a state of a second particular pin during the installation test and, if the state of the second particular pin changes state during the installation test, to use the state of the second particular pin to control when the switch is in the first state and when the switch is in the second state, and if the second particular pin does not change state during the installation test, to not use the state of the second particular pin to control when the switch is in the first state and when the switch is in the second state. The second particular pin may be an audio transfer pin.

In some embodiments, the switch controller is adapted to perform the following: (a) analyze signals on the nurse call audio channel during an installation test, wherein the installation test comprises a first phase in which first audio signals from a television are supplied to the nurse call audio channel and a second phase in which second audio signals from a remotely positioned nurse are supplied to the nurse call audio channel; (b) attempt to identify a distinguishing characteristic between the first and second audio signals; and (c) if a distinguishing characteristic is identified, to use the distinguishing characteristic subsequent to the installation test to control when the switch is in the first state and when the switch is in the second state.

In some embodiments, the switch controller includes a nurse call answer light input that communicates with a nurse call answer light pin from the plurality of pins of the nurse call outlet, and the switch controller puts the switch in the second state when then nurse call answer light pin switches to an active state. Alternatively, or additionally, the switch controller puts the switch in the first state when the nurse call answer light pin switches to an inactive state.

In any of the embodiments disclosed herein, the principles of the present disclosure may be alternatively applied to a stretcher, a chair, a cot, and/or a recliner.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

BRIEF DESCRIPTION OF THE DRAWINGS

FIG. 12 is a chart of a prior art example of the functions of the pins of a 37-pin cable often used in existing healthcare facilities.

DETAILED DESCRIPTION OF THE EMBODIMENTS

Figure 1:
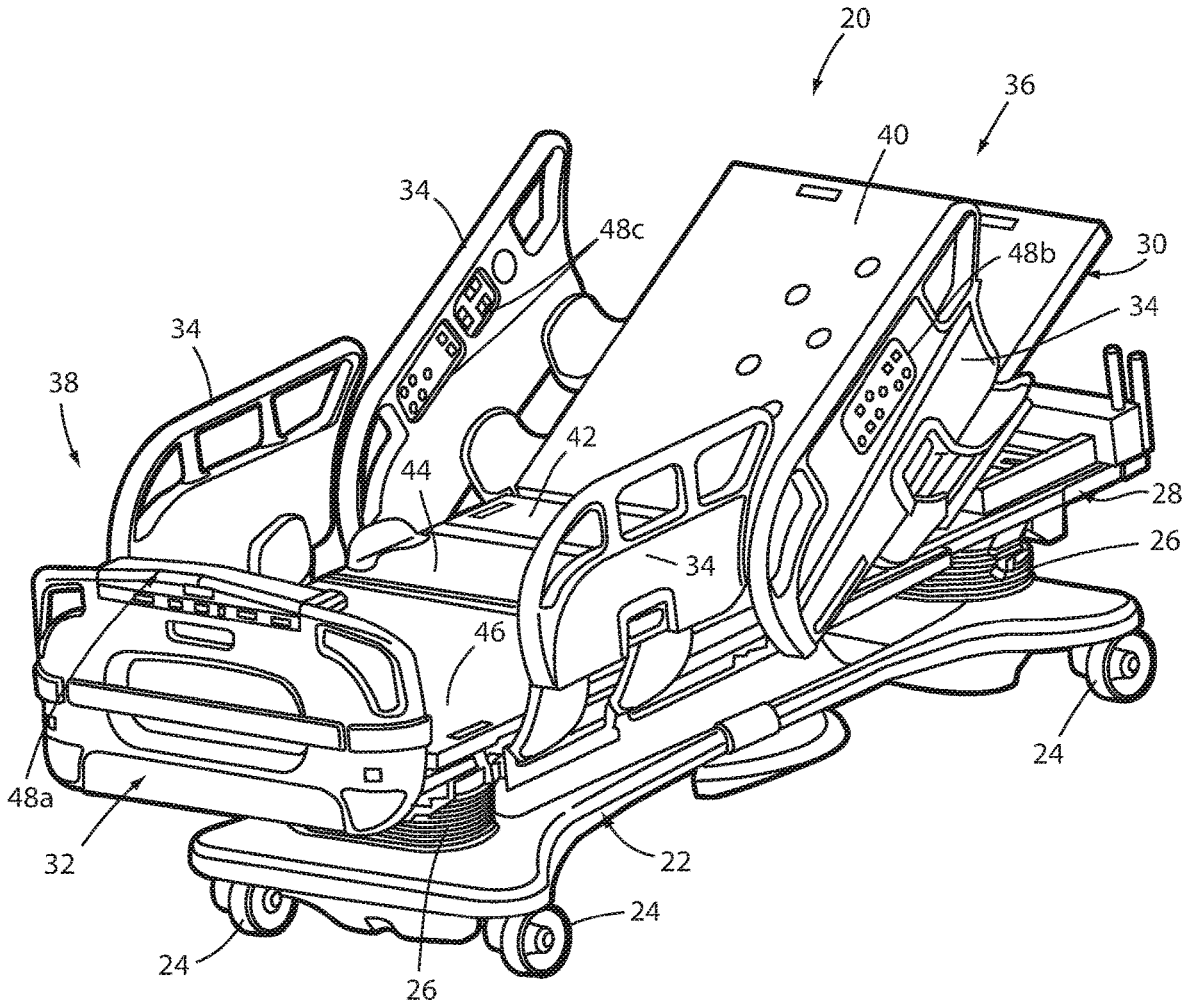
FIG. 1 is a perspective view of a patient support apparatus according to a first embodiment of the present disclosure.

An illustrative patient support apparatus 20 according to a first embodiment of the present disclosure is shown in FIG. 1. Although the particular form of patient support apparatus 20 illustrated in FIG. 1 is a bed adapted for use in a hospital or other medical setting, it will be understood that patient support apparatus 20 could, in different embodiments, be a cot, a stretcher, a recliner, a chair, or any other patient support structure that communicates audio signals with a conventional nurse call system.

In general, patient support apparatus 20 includes a base 22 having a plurality of wheels 24, a pair of lifts 26 supported on the base 22, a litter frame 28 supported on the lifts 26, and a support deck 30 supported on the litter frame 28. Patient support apparatus 20 further includes a footboard 32 and a plurality of siderails 34. Siderails 34 are all shown in a raised position in FIG. 1 but are each individually movable to a lower position in which ingress into, and egress out of, patient support apparatus 20 is not obstructed by the lowered siderails 34.

Lifts 26 are adapted to raise and lower litter frame 28 with respect to base 22. Lifts 26 may be hydraulic actuators, pneumatic actuators, electric actuators, or any other suitable device for raising and lowering litter frame 28 with respect to base 22. In the illustrated embodiment, lifts 26 are operable independently so that the tilting of litter frame 28 with respect to base 22 can also be adjusted. That is, litter frame 28 includes a head end 36 and a foot end 38, each of whose height can be independently adjusted by the nearest lift 26. Patient support apparatus 20 is designed so that when an occupant lies thereon, his or her head will be positioned adjacent head end 36 and his or her feet will be positioned adjacent foot end 38.

Litter frame 28 provides a structure for supporting support deck 30, footboard 32, and siderails 34. Support deck 30 provides a support surface for a mattress (not shown in FIG. 1), such as, but not limited to, an air, fluid, or gel mattress. Alternatively, another type of soft cushion may be supported on support deck 30 so that a person may comfortably lie and/or sit thereon. The top surface of the mattress or other cushion forms a support surface for the occupant. Support deck 30 is made of a plurality of sections, some of which are pivotable about generally horizontal pivot axes. In the embodiment shown in FIG. 1, support deck 30 includes a head section 40, a seat section 42, a thigh section 44, and a foot section 46. Head section 40, which is also sometimes referred to as a Fowler section, is pivotable about a generally horizontal pivot axis between a generally horizontal orientation (not shown in FIG. 1) and a plurality of raised positions (one of which is shown in FIG. 1). Thigh section 44 and foot section 46 may also be pivotable about generally horizontal pivot axes.

Patient support apparatus 20 further includes a plurality of user interfaces 48 that enable a user of patient support apparatus 20, such as a patient and/or an associated caregiver, to control one or more aspects of patient support apparatus 20. In the embodiment shown in FIG. 1, patient support apparatus 20 includes a footboard user interface 48*a*, a pair of outer siderail user interfaces 48*b* (only one of which is visible), and a pair of inner siderail user interfaces 48*c* (only one of which is visible). Footboard user interface 48*a* and outer siderail user interfaces 48*b* are intended to be used by caregivers, or other authorized personnel, while inner siderail user interfaces 48*c* are intended to be used by the patient associated with patient support apparatus 20. Each of the user interfaces 48 includes a plurality of controls (not shown), although each user interface 48 does not necessarily include the same controls and/or functionality. In the illustrated embodiment, footboard user interface 48*a* includes a substantially complete set of controls for controlling patient support apparatus 20 while user interfaces 48*b* and 48*c* include a selected subset of those controls.

Among other functions, the controls of user interfaces 48 allow a user to control one or more of the following: change a height of support deck 30, raise or lower head section 40, activate and deactivate a brake for wheels 24, arm and disarm an exit detection system and, as will be explained in greater detail below, communicate with the particular IT infrastructure installed in the healthcare facility in which patient support apparatus 20 is positioned. One or both of the inner siderail user interfaces 48*c* also include at least one control that enables a patient to call a remotely located nurse (or other caregiver). In addition to the nurse call control, one or both of the inner siderail user interfaces 48*c* also include a speaker 52 (FIG. 5) that enables the patient to hear the nurse's voice and a microphone 54 (FIG. 5) that converts the patient's voice to audio signals that are transmitted to the nurse via a nurse call system.

Footboard user interface 48*a* is implemented in the embodiment shown in FIG. 1 as a control panel having a lid (flipped down in FIG. 1) underneath which is positioned a plurality of controls. As with all of the controls of the various user interfaces 48, the controls of user interface 48*a* may be implemented as buttons, dials, switches, or other devices. Any of user interfaces 48*a-c* may also include a display for displaying information regarding patient support apparatus 20. The display is a touchscreen in some embodiments.

Figure 2:
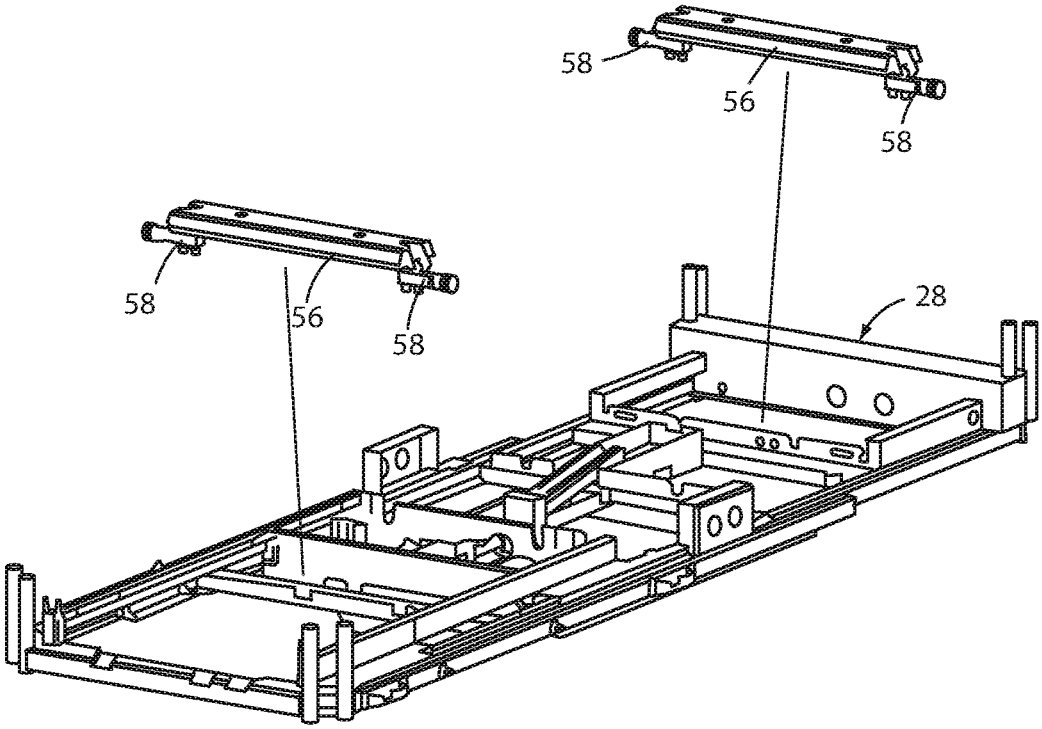
FIG. 2 is a perspective view of a litter and a pair of lift header assemblies with force sensors of the patient support apparatus of FIG. 1.

FIG. 2 illustrates in greater detail litter frame 28 separated from lifts 26 and base 22. Litter frame 28 is also shown in FIG. 2 with support deck 30 removed. Litter frame 28 is supported by two lift header assemblies 56. A first one of the lift header assemblies 56 is coupled to a top 60 (FIG. 3) of a first one of the lifts 26, and a second one of the lift header assemblies 56 is coupled to the top 60 of the second one of the lifts 26. Each lift header assembly 56 includes a pair of force sensors 58, which will be described herein as being load cells, but it will be understood that force sensors 58 may be other types of force sensors besides load cells. The illustrated embodiment of patient support apparatus 20 includes a total of four load cells 58, although it will be understood by those skilled in the art that different numbers of load cells may be used in accordance with the principles of the present disclosure. Load cells 58 are configured to support litter frame 28. More specifically, load cells 58 are configured such that they provide complete and exclusive mechanical support for litter frame 28 and all of the components that are supported on litter frame 28 (e.g. support deck 30, footboard 32, siderails 34, etc.). Because of this construction, load cells 58 are adapted to detect the weight of not only those components of patient support apparatus 20 that are supported by litter frame 28 (including litter frame 28 itself), but also any objects or persons who are wholly or partially being supported by support deck 30.

Figure 3:
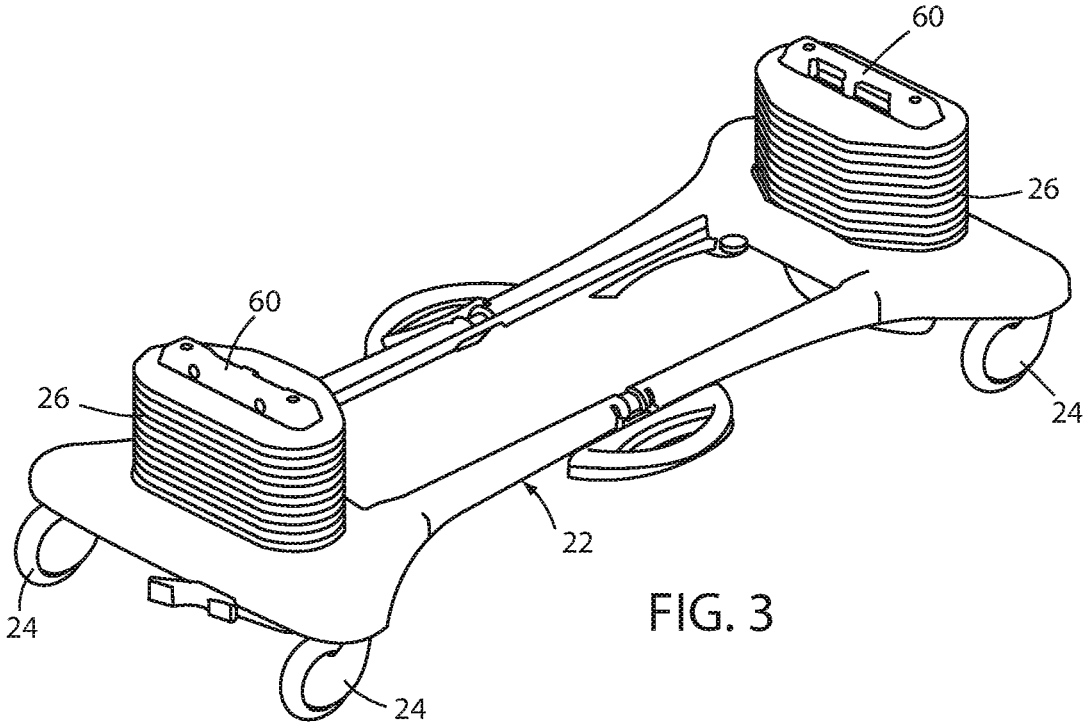
FIG. 3 is a perspective view of a base of the patient support apparatus of FIG. 1.

The mechanical construction of patient support apparatus 20, as shown in FIGS. 1-3, is the same as, or nearly the same as, the mechanical construction of the Model 3002 S3 bed manufactured and sold by Stryker Corporation of Kalamazoo, Mich. This mechanical construction is described in greater detail in the Stryker Maintenance Manual for the MedSurg Bed, Model 3002 S3, published in 2010 by Stryker Corporation of Kalamazoo, Mich., the complete disclosure of which is incorporated herein by reference. It will be understood by those skilled in the art that patient support apparatus 20 can be designed with other types of mechanical constructions, such as, but not limited to, those described in commonly assigned, U.S. Pat. No. 7,690,059 issued to Lemire et al., and entitled HOSPITAL BED; and/or commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosures of both of which are also hereby incorporated herein by reference. The mechanical construction of patient support apparatus 20 may also take on forms different from what is disclosed in the aforementioned references.

Load cells 58 are part of an exit detection system that, when armed, issues an alert when patient exits from patient support apparatus 20. The exit detection system is adapted to be armed via user interface 48. After being armed, the exit detection system determines when an occupant of patient support apparatus 20 has left, or is likely to leave, patient support apparatus 20, and issues an alert and/or notification to appropriate personnel so that proper steps can be taken in response to the occupant's departure (or imminent departure) in a timely fashion. In at least one embodiment, the exit detection system monitors the center of gravity of the patient using the system and method disclosed in commonly assigned U.S. Pat. No. 5,276,432 issued to Travis and entitled PATIENT EXIT DETECTION MECHANISM FOR HOSPITAL BED, the complete disclosure of which is incorporated herein by reference. In other embodiments, the exit detection system determines if the occupant is about to exit, or already has exited, from patient support apparatus 20 by determining a distribution of the weights detected by each load cell 58 and comparing the detected weight distribution to one or more thresholds. In such embodiments, the center of gravity may or may not be explicitly calculated.

Other manners for functioning as an exit detection system are also possible. These include, but are not limited to, any of the manners disclosed in the following commonly assigned patent applications: U.S. patent application Ser. No. 14/873,734 filed Oct. 2, 2015, by inventors Marko Kostic et al. and entitled PERSON SUPPORT APPARATUS WITH MOTION MONITORING; U.S. patent publication 2016/0022218 filed Mar. 13, 2014, by inventors Michael Hayes et al. and entitled PATIENT SUPPORT APPARATUS WITH PATIENT INFORMATION SENSORS; and U.S. patent application Ser. No. 15/266,575 filed Sep. 15, 2016, by inventors Anuj Sidhu et al. and entitled PERSON SUPPORT APPARATUSES WITH EXIT DETECTION SYSTEMS , the complete disclosures of all of which are incorporated herein by reference. Further, in some embodiments, load cells 58 may be part of both an exit detection system and a scale system that measures the weight of a patient supported on support deck 30. The outputs from the load cells 58 are processed, in some embodiments, in any of the manners disclosed in commonly assigned U.S. patent application Ser. No. 62/428,834 filed Dec. 1, 2016, by inventors Marko Kostic et al. and entitled PERSON SUPPORT APPARATUSES WITH LOAD CELLS, the complete disclosure of which is incorporated herein by reference.

Regardless of how implemented, patient support apparatus 20 is adapted to communicate an alert when the exit detection system is armed and detects that a patient is about to, or has, exited. The alert is communicated to a conventional nurse call system via a nurse call interface onboard the bed. The alert may also be communicated elsewhere using other communication techniques (e.g. WiFi). The manner in which the alert is communicated to the nurse call system, as well as the manner in which the bed generally interacts with the existing IT infrastructure of a typical healthcare facility will now be described in more detail.

Figure 4:
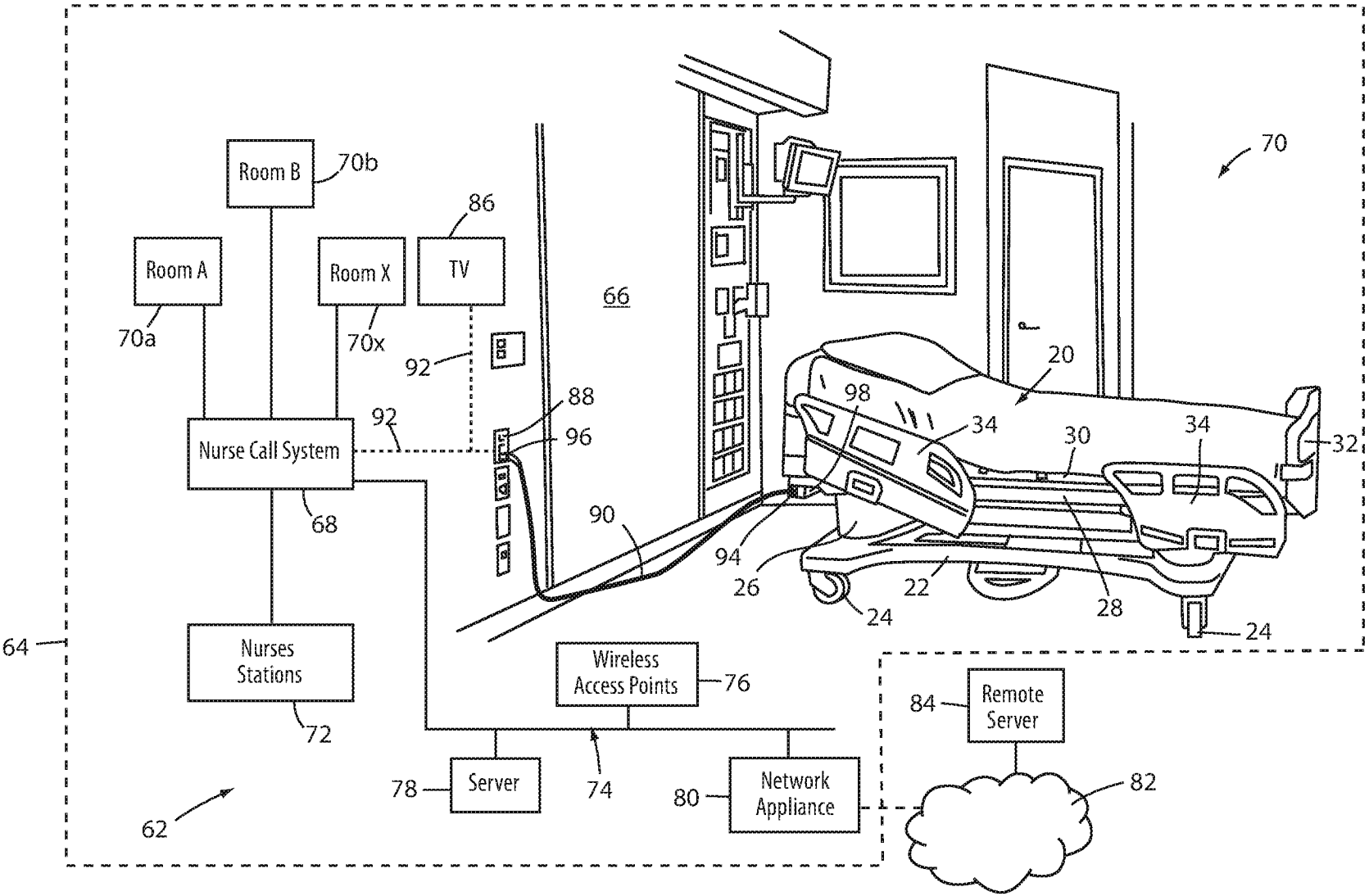
FIG. 4 is a diagram of the patient support apparatus of FIG. 1 shown communicatively coupled to the IT infrastructure of a healthcare facility in a typical manner.

FIG. 4 illustrates patient support apparatus 20 coupled to the IT infrastructure 62 of a healthcare facility 64 according to one common configuration. As shown therein, healthcare facility 64 includes a headwall 66, a nurse call system 68, a plurality of rooms 70 (70*a*, 70*b* . . . 70*x*), one or more nurses' stations 72, a local area network 74, one or more wireless access points 76, a bed server 78, and one or more network appliances 80 that couple LAN 74 to the internet 82, thereby enabling servers and other applications on LAN 74 to communicate with computers outside of healthcare facility 64, such as, but not limited to, a geographically remote server 84. IT infrastructure 62 also be configured to interact with one or more room televisions 86. It will be understood by those skilled in the art that the particular components of the IT infrastructure 62 of healthcare facility 64 shown in FIG. 4 may vary widely. For example, patient support apparatus 20 may be used in healthcare facilities having no wireless access points 76, no connection to the internet 82 (e.g. no network appliances 80), and/or no bed server 78. Still further, local area network 74 may include other and/or additional servers installed thereon, and nurse call system 68, in some healthcare facilities 64, may not be coupled to the local area network 74. Patient support apparatus 20 is capable of being installed in healthcare facilities 64 having still other variations of the IT infrastructure 62 illustrated in FIG. 4. It will therefore be understood that the particular IT infrastructure 62 shown in FIG. 4 is merely illustrative, and that patient support apparatus 20 is constructed to be communicatively coupled to IT infrastructures arranged differently from that of FIG. 4, some of which are discussed in greater detail below.

Patient support apparatus 20 is coupled to a nurse call outlet 88 on headwall 66 by way of a cable 90. Nurse call outlet 88, in turn, is coupled to one or conductors 92 that electrically couple the nurse call outlet 88 to nurse call system 68 and to one or more other devices, such as a television 86. Conductors 92 are typically located behind headwall 66 and not visible. In some healthcare facilities, conductors 92 may first couple to a room interface board 128 (FIG. 5) that includes one or more electrical connections electrically coupling the room interface board 128 to television 86 and/or nurse call system 68. Still other communicative arrangements for coupling nurse call outlet 88 to nurse call system 68 and television 86 are possible.

Cable 90 (FIG. 4) enables patient support apparatus 20 to communicate with nurse call system 68 and/or television 86. A patient supported on patient support apparatus 20 who activates a nurse call control on patient support apparatus 20 causes a signal to be conveyed via cable 90 to the nurse call system 68, which then sends a notification to one or more remotely located nurses (e.g. nurses at one of the nurses' stations 72). If the patient uses a TV control positioned on one of the user interfaces (e.g. user interface 48*c*) to change a channel or change the volume of television 86, the control conveys a signal along cable 90 to the nurse call outlet 88, and the signal is thereafter passed from outlet 88 to television 86. As will be discussed in greater detail below, cable 90 often includes a plurality of pins (e.g. 37 pins), and the audio signals that are passed between the patient when positioned on the patient support apparatus 20 and a remotely positioned nurse are transmitted over a separate set of pins than the control signals used to control television 86. However, as will also be discussed in greater detail below, the audio signals of a remotely positioned nurse are often transmitted to the patient support apparatus 20 over the same pins as the pins used to transmit the audio signals from the television. These audio signals are used to drive a speaker (e.g. speaker 52 of FIG. 5) onboard patient support apparatus 20.

In order for patient support apparatus 20 to properly communicate with nurse call system 68, patient support apparatus 20 needs to be configured in a manner that physically matches the particular nurse call outlet 88 and that functionally matches how the nurse call system 68 utilizes the pins of nurse call outlet 88. In other words, different healthcare facilities 64 may utilize different brands and/or models of nurse call systems 68, and such different systems may utilize different types of nurse call outlets 88. One manner of ensuring patient support apparatus 20 is able to communicate with the particular nurse call system 68 within a given healthcare facility 64 is to utilize a customized cable 90 that correctly routes the pins of the cable 90 that are coupled to nurse call outlet 88 to the pins of cable 90 that are coupled to patient support apparatus 20. Other manners of ensuring the patient support apparatus 20 is properly configured to talk to nurse call system 68 via cable 90 are disclosed in commonly assigned U.S. patent application Ser. No. 15/945,437 filed Apr. 4, 2018, by inventors Krishna Bhimavarapu et al. and entitled PATIENT SUPPORT APPARATUSES WITH RECONFIGURABLE COMMUNICATION, the complete disclosure of which is incorporated herein by reference. Still other manners of configuring patient support apparatus 20 to match the existing nurse call system 68 may be utilized.

Figure 10:
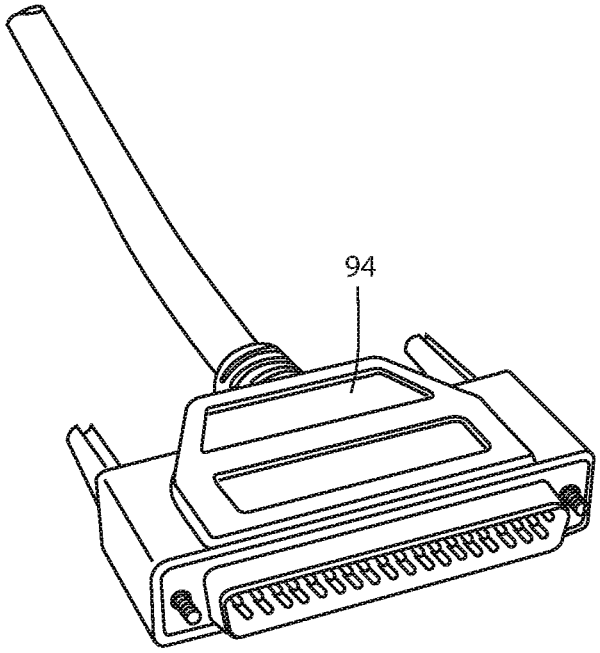
FIG. 10 (Prior Art)
FIG. 10 is a perspective view of a prior art 37-pin male cable connector.
Figure 11:
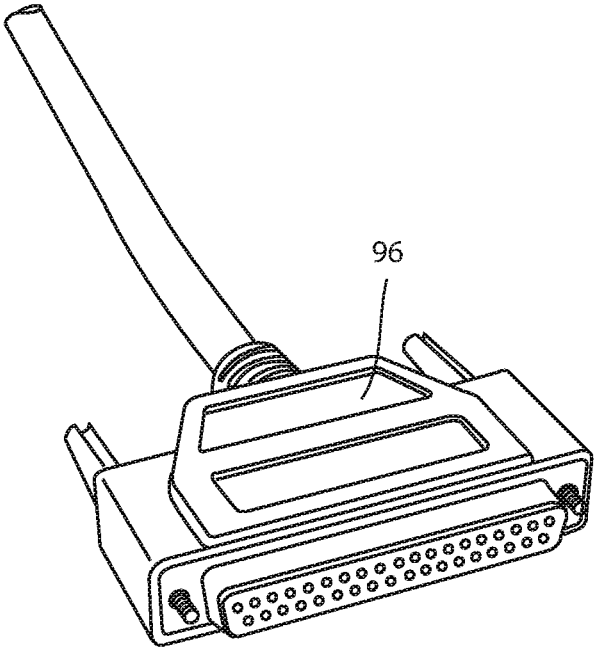
FIG. 11 (Prior Art)
FIG. 11 is a perspective view of a prior art 37-pin female cable connector.

Cable 90 includes a first end having a first connector 94 and a second end having a second connector 96 (FIG. 4). First connector 94 is adapted to be plugged into a nurse call interface 98 positioned on patient support apparatus 20. Second connector 96 is adapted to be plugged into nurse call outlet 88. In many healthcare facilities 64, nurse call outlet 88 is configured as a 37-pin receptacle. In such facilities, cable 90 includes first and second connectors 94 and 96 having 37 pins (one of which may be a male connector and the other of which may be a female connector, although other combinations may be used). One example of a male 37-pin connector 94, 96 that may be used as first or second connector 94 or 90 is shown in FIG. 10. One example of a female 37-pin connector 94, 96 that may be used as first or second connector 94 or 96 is shown in FIG. 11. Other types of 37-pin connectors may also be used, depending upon the configuration of nurse call outlet 88. Still further, in some healthcare environments, nurse call outlet 88 includes fewer pins and/or has an arrangement of pins that is shaped to match a cable 90 having connectors different from what is shown in FIGS. 10 and 11. Patient support apparatus 20 is adapted to communicate with all of these different types of nurse call outlets 88 via an appropriately selected cable (e.g. one with the proper connectors 94, 96 on its ends).

Further details regarding the manner in which patient support apparatus 20 communicates audio signals to and from nurse call system 68 are provided below and illustrated in FIG. 5. As shown therein, patient support apparatus 20 includes a cable port 100 that is adapted to electrically couple to the first connector 94 of cable 90 when cable 90 is plugged into a cable port 100 of patient support apparatus 20. Cable port 100 is part of, and/or is in communication with, nurse call interface 98. In addition to cable port 100, nurse call interface 98 includes a switch 102, a switch controller 104, a nurse call audio channel 120, a patient support apparatus speaker channel 122 (hereinafter "bed speaker channel 122") coupled to speaker 52, and a patient support apparatus microphone channel 124 (hereinafter "bed microphone channel 124") coupled to microphone 54.

Nurse call audio channel 120 is adapted to communicatively couple to a pair of pins 130*a* and 130*b* of cable port 100 that match a pair of pins 130*a* and 130*b* of nurse call outlet 88. Pins 130*a* and 103*b* of nurse call outlet 88 are designed to transfer audio signals between the nurse call system and patient support apparatus 20. In a common conventional pin layout of a nurse call outlet 88, such as the one shown in FIG. 12, pins 130*a* and 103*b* correspond to pins 4 and 35, which are labeled therein as "speaker high" and "speaker low," respectively. These are the pins which the nurse call system 68 uses to transmit audio signals from a remotely positioned nurse to the bed. These pins are also used by the nurse call system 68 to transmit the patient's voice (audio signals) from the patient support apparatus 20 to the remotely positioned nurse.

In virtually all current conventional nurse call systems 68, the two pins used to transmit audio between a remotely positioned nurse and the patient support apparatus 20 (pins 130*a*, 130*b*) form a half duplex communication channel that is only able to communicate such audio signals in one direction. Further, as noted previously, it is typically, if not exclusively, the case that the nurse call system 68 controls which direction information is flowing over this audio communication channel at any given time. As will be explained in greater detail below, nurse call interface 98 of patient support apparatus 20 is adapted to work in conjunction with the half duplex communication channel and determine when signals are being communicated to patient support apparatus 20 and when signals are able to be sent to the remotely positioned nurse. This determination is used by nurse call interface 98 to decide, among other things, whether the nurse call audio channel 120 should be coupled to bed speaker channel 122 (and thus speaker 52) or to bed microphone channel 124 (and thus microphone 54). When coupled to bed speaker channel 122, nurse call interface 98 is able to emit sound waves via speaker 52 that reproduce the audio signals received from the nurse call system 68 so that the patient is able to hear the remote nurse's voice. When coupled to bed microphone channel 122, nurse call interface 98 is able to transmit the patient's voice, as detected by microphone 54, to the remotely positioned nurse.

In the illustrated embodiment (FIG. 5), switch controller 104 includes a nurse call audio analyzer 106, a patient audio analyzer 108, a nurse call light input 110, a nurse call answer light input 112, an auxiliary microphone input 114, and a talk switch input 116. Nurse call audio analyzer 106, patient audio analyzer 108, nurse call light input 110, nurse call answer light input 112, auxiliary microphone input 114, and talk switch input 116 all feed into a set of control logic 118. In some embodiments, switch controller 104 is implemented as, and/or include, one or more conventional microcontrollers. In other embodiments, switch controller 104 may be modified to use a variety of other types of circuits—either alone or in combination with one or more microcontrollers—such as, but not limited to, any one or more microprocessors, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by the microcontroller (if included) when carrying out the functions described herein, as well as the data necessary for carrying out these functions, are stored in a memory that is accessible to switch controller 104.

Switch controller 104 (FIG. 5) is adapted to control switch 102. That is, switch controller 104 is adapted to change switch 102 between a first state in which nurse call audio channel 120 is coupled to bed microphone channel 124 and a second state in which nurse call audio channel 120 is coupled to bed speaker channel 122. Generally speaking, switch controller 104 is configured to put switch 102 in the first state when the patient is speaking to the remotely positioned nurse and to put switch 102 in the second state when the remote nurse is speaking to the patient. When the patient speaks to the remote nurse, the patient's audio signals are captured by microphone 54 and delivered to a remote nurse speaker 126, and when the nurse speaks, the nurse's audio signals are captured by a nurse microphone 136 and delivered to speaker 52.

It will also be understood that, at least in some embodiments, switch controller 104 may be configured to change switch 102 to a third and neutral state. In such embodiments, switch controller 104 puts switch 102 in the third and neutral state when no audio communications are taking place between the patient and a remotely positioned nurse, and no television audio signals are being transmitted to the patient support apparatus 20 via nurse call audio channel 120. This neutral state may be used to reduce or eliminate noise that otherwise might be generated via speaker 52 and/or to eliminate power consumption of speaker 52 and/or microphone 54.

In addition to controlling the state of switch 102, switch controller 104 may be adapted to control other aspects of nurse call interface 98. For example, in some embodiments, nurse call interface 98 includes one or more bidirectional amplifiers (not shown) that are coupled to one or more of the nurse call audio channel 120, speaker channel 122, and/or microphone channel 124. In such embodiments, in addition to controlling the state of switch 102, switch controller 104 may be configured to control the directionality of the bidirectional amplifier. Thus, for example, if a remote nurse is speaking to the patient, the incoming signals on nurse call audio channel 120 may be amplified before being delivered to speaker 52. However, if the patient is speaking, the audio signals received from microphone 54 may be amplified before being sent along nurse call audio channel 120 back to the remotely positioned nurse (via pins 130*a*, 130*b*, and conductor 92).

The decision as to when to change switch 102 between the first and second states is carried out by the control logic 118 based upon one or more inputs. Such inputs come from one or more of the following components of switch controller 104: nurse call audio analyzer 106, patient audio analyzer 108, nurse call light input 110, nurse call answer light input 112, auxiliary microphone input 114, and/or talk switch input 116. It will be understood by those skilled in the art that switch controller 104 may be modified substantially such that control logic 118 uses fewer inputs to determine how to control switch 102, or such that control logic 118 uses additional inputs to determine how to control switch 102. Thus, for example, in some embodiments, one or both of audio analyzers 106 and/or 108 are omitted; in some embodiments nurse call light input 110 and/or nurse call answer light input 112 are omitted; and/or in some embodiments either or both of auxiliary microphone input 114 and/or talk switch input 116 are omitted. Still other modifications to switch controller 104 may be implemented.

When included, nurse call light input 110 (FIG. 5) is electrically coupled to a pin 130*c* that electrically couples to a nurse call light pin 130*c* of nurse call outlet 88 (when cable 90 is connected between patient support apparatus 20 and nurse call outlet 88). Pin 130*c* is identified in the example of FIG. 12 as corresponding to pin 19 of the 37-pin connector layout shown therein. Pin 19 in the example of FIG. 12 is described therein as a "Nurse Call Light+" pin. In general, conventional nurse call systems 68 control the "Nurse Call Light+" pin in the following manner. When a patient presses a nurse call button (or other control) on the patient support apparatus 20 indicating that the patient wishes to speak with a remotely positioned nurse, this is detected by the nurse call system 68. When nurse call system 68 detects this pressing of the nurse call button, it sends a signal via pin 130*c* (pin 19 in the example of FIG. 12) that is intended to cause a light onboard patient support apparatus 20 to illuminate, thereby confirming to the patient that he or she has, in effect, placed a call to the remotely positioned nurse. Thus, the state of pin 130*c* changes when the nurse call system 68 detects that a patient has called the remotely positioned nurse.

Figure 5:
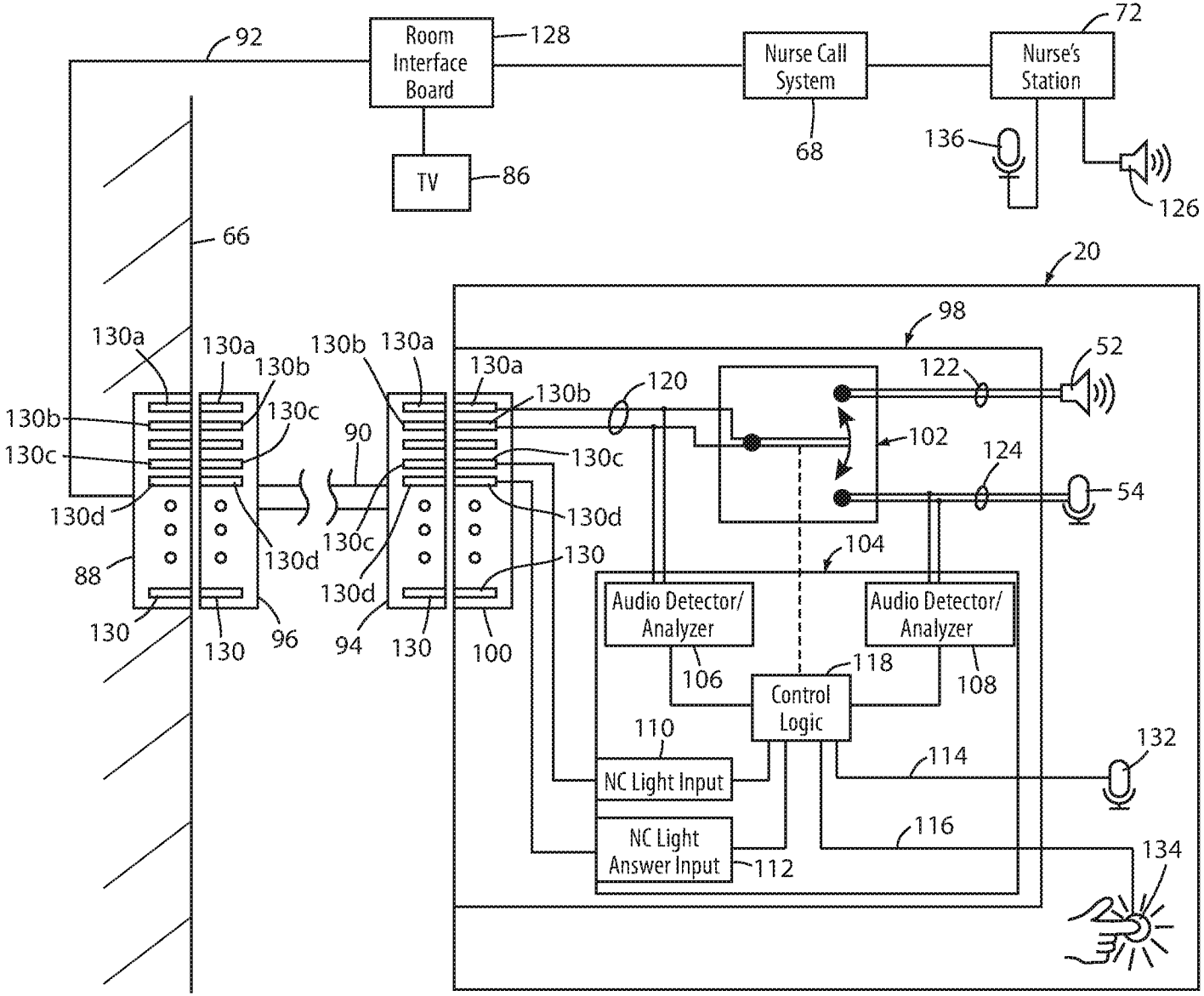
FIG. 5 is a diagram of the components of FIG. 4 showing a nurse call interface onboard the patient support apparatus in greater detail.

In the embodiment of patient support apparatus 20 shown in FIG. 5, pin 130*c* is fed into nurse call light input 110, which in turn feeds the signal to control logic 118. It will be understood that, although not shown in FIG. 5, patient support apparatus 20 also routes pin 130*c* to an onboard light that illuminates in response to the patient calling the nurse. Thus, patient support apparatus 20 uses the signals on pin 130*c* for two purposes: to control the illumination of a nurse call light, and to control the state of switch 102.

When included, nurse call answer light input 112 (FIG. 5) is electrically coupled to a pin 130*d* that electrically couples to a nurse call answer light pin 130*d* of nurse call outlet 88 (when cable 90 is connected between patient support apparatus 20 and nurse call outlet 88). Pin 130*d* is identified in the example of FIG. 12 as corresponding to pin 16 of the 37-pin connector layout shown therein. Pin 16 in the example of FIG. 12 is described therein as a "Nurse Answer Light+" pin. In general, conventional nurse call systems 68 control the "Nurse Answer Light+" pin in the following manner. After a patient has pressed a nurse call button (or other control) on the patient support apparatus 20 indicating that the patient wishes to speak with a remotely positioned nurse, and the nurse call system has sent a signal via pin 130*c* (pin 19 in the example of FIG. 12) to illuminate a light onboard the patient support apparatus 20, most conventional nurse call systems 68 will also send a separate signal over pin 130*d* (pin 16 in FIG. 12) when the nurse actually answers the call placed by the patient. Thus, patient support apparatus 20 includes a first light (not shown) that is illuminated when the patient initially places the call to the nurse, and a second light (also not shown) that is illuminated when the nurse answers the call. The illumination of the first light is controlled by a signal received from pin 130*c* while the illumination of the second light is controlled by a signal received from pin 130*d*. The second light provides a visual indication to the patient that the remote nurse is talking.

It will be understood that, although the embodiment of patient support apparatus 20 shown in FIG. 5 does not show this, pin 130*d* is also fed into the second light mentioned above, the nurse call answer light. This is in addition to being fed into nurse call answer light input 112, which in turn feeds into control logic 118. Therefore patient support apparatus 20 utilizes the signal on pin 130*d* for dual purposes and routes it to at least two different recipients: to an onboard answer light that illuminates in response to the nurse answering the patient's call, and to an onboard nurse call answer light.

Nurse call audio analyzer 106 (FIG. 5), when included, is configured to detect signals on nurse call audio channel 120. Nurse call audio analyzer 106 is also configured, in at least some embodiments, to distinguish between audio signals on nurse call audio channel 120 that are from a remotely positioned nurse and those that are from television 86. As noted previously, many nurse call systems route signals from a remotely positioned nurse call microphone 136 (FIG. 5) to the patient support apparatus 20 over the same audio channel (pins 130*a* and 130*b*) as they do signals from television 86. Thus, nurse call audio analyzer 106 is configured, in at least some embodiments, to distinguish between audio signals on nurse call audio channel 120 that are generated by television 86 and audio signals generated by the remotely positioned nurse call microphone 136.

In at least one embodiment, nurse call audio analyzer 106 is configured to distinguish between the television audio signals and the nurse audio signals by first detecting signals on channel 120 and then sending a mute command (or other volume reduction command) to the television 86. After sending this command, nurse call audio analyzer 106 monitors the audio signals on channel 120 and looks for a corresponding reduction in their amplitude (or disappearance, if the volume of television 86 is completely muted). If nurse call audio analyzer 106 detects the corresponding decrease in volume, it concludes that the audio signals on channel 120 are currently coming from television 86. If the nurse call audio analyzer 106 does not detect the corresponding decrease in volume, it concludes that the audio signals on channel 120 are coming from the remotely positioned nurse call microphone 136. As will be explained in greater detail below, nurse call audio analyzer 106 forwards this conclusion to control logic 118 which uses it to control the state of switch 102. Control logic 118 is therefore apprised of whether a remotely positioned nurse is currently sending audio signals to patient support apparatus 20, television 86 is currently sending audio signals to patient support apparatus 20, or no device is currently sending audio signals to patient support apparatus 20.

After sending the mute or volume reduction command to television 86 and monitoring the resultant change, or lack of change, in the signals on nurse call audio channel 120, nurse call audio analyzer 106 subsequently sends one or more commands to rescind the prior mute or volume reduction command. That is, if analyzer 106 sends a mute command, it sends an unmute command after checking to see if the signals on audio channel 120 have responded to the mute command or not. Similarly, if analyzer 106 sends a volume reduction command, it sends a commensurate volume increase command after checking to see if the signals on audio channel 120 have responded to the volume reduction command or not. The time between the sending of the first command and the subsequent counteracting command may be less than a second such that, to the extent audio signals are present on channel 120 that are originating from TV 86, the disturbance to the patient of those signals being muted or reduced in volume, is minimized.

The mute command or volume reduction command sent by nurse call audio analyzer 106 (FIG. 5) to television 86 is sent over separate pins 130 from pins 130*a*, 130*b*. Most nurse call systems 68 include separate pins for carrying out such television control. For example, in the 37-pin connector example shown in FIG. 12, pins 33 and 34, which are labeled "TV−" and "TV+" can be used to send the volume change commands from nurse call audio analyzer 106 to television 86. The specific pins 130 of FIG. 5 that correspond to pins 33 and 34 of FIG. 12 are not labeled in FIG. 5 because FIG.

5 only displays an abbreviated set of the pins that are typically present on nurse call outlet 88. Were such pins illustrated in FIG. 5 they would be electrically coupled to both nurse call audio analyzer 106 and the patient control(s) onboard patient support apparatus 20 that the patient is able to use to adjust the volume of television 86.

Nurse call audio analyzer 106 may also, or alternatively, be configured to determine whether audio signals on channel 120 originated from television 86 or remote nurse call microphone 136 by analyzing one or more characteristics of those audio signals. Such characteristics include the spectral content of the audio signals, the average amplitude, whether any DC components are present or not, etc. In some embodiments, nurse call interface 98 is adapted to undergo an installation test during which cable 90 is plugged into patient support apparatus 20 and nurse call outlet 88 while a television 86 sends TV audio signals over conductor 92 to pins 130*a* and 130*b* of nurse call interface 98. Nurse call audio analyzer 106 is informed during this testing phase that the audio signals on channel 120 are originating from television 86, and it measures and records various characteristics of those audio signals during this time period. After a sufficiently long time period of monitoring the TV audio signals on channel 120 (sufficient to measure and identify one or more spectral characteristics of the TV audio signals), the installation test switches to a second phase in which nurse call signals from remote nurse call microphone 136 are routed to pins 130*a* and 130*b* of nurse call interface 98. During this second phase, nurse audio analyzer 106 is informed that the audio signals on channel 120 are from the nurse call microphone 136. Once again, nurse audio analyzer 106 monitors these nurse call audio signals, takes various spectral and/or amplitude measurements, and records those measurements. Thereafter, nurse call audio analyzer 106 compares the measurements taken during the first phase with those taken during the second phase and determines if any are different enough to be useful markers for distinguishing future nurse call audio signals from future television audio signals. Regardless of the outcome of this determination, nurse call audio analyzer 106 is configured to send a message to a display onboard patient support apparatus 20 (not shown) indicating to the user that a sufficient number of useful markers were or were not detected for enabling nurse call audio analyzer 106 to distinguish between television and nurse audio signals in the future.

In some embodiments, the first and second phases of the testing may be repeated one or more times with the outcomes from each testing phase fed into one or more artificial intelligence learning algorithms such that the analyzer 106 is taught by a combination of the algorithms and the repeated testing to distinguish between TV and nurse audio signals. Such artificial intelligence algorithms may comprise one or more machine learning algorithms and/or predictive modeling algorithms. In still other embodiments, nurse call audio analyzer 106 may be configured to distinguish between nurse audio signals and television audio signals in still other manners.

Patient audio analyzer 108 (FIG. 5), when included, analyzes the audio signals on bed microphone channel 124. Such audio signals originate from microphone 54. In some embodiments, patient audio analyzer 108 is configured to distinguish between audio signals generated by the patient's voice and audio signals generated from other sources (e.g. background noise, aural alerts, etc.). In some embodiments, patient audio analyzer 108 includes conventional echo cancellation circuitry that is adapted to remove any components of the audio signals on channel 124 that are due to sounds emitted by speaker 52 and detected by microphone 54. When patient audio analyzer 108 detects audio signals on channel 124 that are due to the patient speaking, it sends a signal to control logic 118.

In some embodiments, patient support apparatus 20 includes an auxiliary microphone 132 (FIG. 5). When included, auxiliary microphone 132 is positioned near microphone 54 so that when a patient speaks into microphone 54, the patient's voice is also detected by auxiliary microphone 132. Auxiliary microphone 132 therefore detects when a patient is speaking and may be utilized in lieu of patient audio analyzer 108, or in addition to patient audio analyzer 108. Auxiliary microphone 132, in some embodiments, is a low power microphone that, when it detects audio, such as the voice of a patient talking, it sends a signal to control logic 118 indicating that the patient is talking. Control logic 118 uses this information to determine what state to put switch 102 into. In some embodiments, control logic 118 retains switch 102 in the second state until it receives a signal from auxiliary microphone 132 indicating that the patient is talking. In other embodiments, control logic 118 considers the signal from auxiliary microphone 132 in combination with other inputs it receives from the other components of nurse call interface 98 when deciding upon the state of switch 102. Still other manners of using signals from auxiliary microphone input 114 may be implemented.

In some embodiments, patient support apparatus 20 includes a talk switch 134 (FIG. 5). Talk switch 134 is physically implemented in the embodiment shown in FIG. 5 as a button that is intended to be pressed by the patient when the patient wishes to talk to the remotely positioned nurse. Talk switch 134 may be physically implemented in other manners, such as a membrane switch, a touch screen input, a dial, etc. However implemented, the output of talk switch 134 is fed to control logic 118 via talk switch input 116. In some embodiments, talk switch 134 is the same control activated by the patient when he or she wishes to call a remotely positioned nurse. In other embodiments, the patient may call the remotely positioned nurse using a separate button (or other type of control) that is separate from talk switch 134. Regardless of whether or not talk switch 134 is the same as the control initially used to place a call to the remote nurse, if the patient wishes to speak, the patient presses and holds talk switch 134 for as long as he or she wishes to speak. When he or she wishes to allow the nurse to talk, he or she releases talk switch 134. In this manner, communication between the patient and the nurse utilizing talk switch 134 resembles communication using a conventional walkie-talkie: to talk, talk switch 134 is pressed and held; to listen, talk switch 134 is released.

In at least one embodiment of nurse call interface 98, control logic 118 uses the output from talk switch 134 to control the state of switch 102 without utilizing the output from (or even including) analyzers 106, 108, auxiliary microphone 132, nurse call light input 110, and/or nurse call answer light input 112. In this particular embodiment, switch controller 104 controls the state of switch 102 according to the following truth table.

| Talk Switch 134 State | Switch 102 State |
|---|---|
| activated (e.g. pressed) | first state |
| deactivated (e.g. not pressed | second state |

It will be understood that control logic 118 implements this truth table when after a nurse call has been placed by the patient, or after a nurse has placed a call to the patient. After the conversation between the nurse and patient has finished, switch controller 104 may change switch 102 to a third state to reduce noise. Alternatively, or additionally, switch controller 104 may shut off its amplifier and/or cut power to speaker 52 and/or microphone 54.

It will also be understood that, in those embodiments of nurse call interface 98 that include talk switch 102, talk switch 102 often replaces the function of auxiliary microphone 132. Thus, most, but not necessarily all, embodiments of nurse call interface 98 will include either auxiliary microphone 132 or talk switch 134, but not both. In those embodiments that include auxiliary microphone 132 but not talk switch 134, control logic 118 may implement a truth table like that shown above wherein the first column is replaced by the two states of auxiliary microphone 132 (detecting patient audio or not detecting patient audio).

Still further, in at least some embodiments of nurse call interface 98 that utilize talk switch 134, nurse call interface 98 is modified from what is shown in FIG. 5 to omit one or more of the following components: nurse audio analyzer 106, patient audio analyzer 108, and/or one or more of inputs 110 and/or 112. However, in at least one embodiment of nurse call interface 98 that utilizes talk switch 134, inputs 110 and 112 are used to determine when a conversation between the nurse and patient has started and when it has ended.

In another embodiment of nurse call interface 98, control logic 118 follows the logic set forth in the following alternative truth table.

| State of Nurse Call Light Pin 130c | State of Nurse Call Answer Light Pin 130d | State of Switch 102 | Description |
|---|---|---|---|
| deactivated | deactivated | neutral (or third state) | no call |
| activated | deactivated | neutral (or third state) | nurse call has been placed |
| deactivated | activated | second state | nurse talk back is active (nurse has answered and is talking) |
| deactivated | deactivated | first state | patient is talking after nurse has responded to the call |
| activated | activated | neutral (or third state) | error |

When following this particular truth table, switch controller 104 controls the state of switch 102 based purely on inputs 110 and 112, as well as the detection of whether a call is currently taking place or has ended. Switch controller 104 couples nurse call audio channel 120 to bed speaker channel 122 (and speaker 52) when the nurse is talking, as detected by a signal from nurse call answer light input 112, and couples nurse call audio channel 120 to bed microphone channel 124 (and microphone 54) when the patient is talking. In some embodiments, nurse call audio analyzer 106 is configured to detect the end of a nurse call by detecting a change in the characteristics of the signals on nurse call audio channel 120. It will be understood that other manners of detecting the end of a nurse call may be employed, either additionally or alternatively to nurse call audio analyzer 106.

In still another embodiment, switch controller 104 is implemented without inputs 110 and 112, as well as without one or more both of auxiliary microphone input 114 and talk switch input 116. In such embodiments, switch controller 104 is configured to control the state of the switch 102 based upon whichever audio channel 120 or 124 is detecting speech (as detected by analyzers 106 and 108, respectively). In this embodiment, if a nurse's audio signals (as opposed to audio signals from TV 86) are detected on nurse call audio channel 120, switch controller 104 changes switch 102 to the second state in which the nurse's audio signals are delivered to speaker 52. If a patient's audio signals are detected on bed microphone channel 124, switch controller 104 changes switch 102 to the first state in which the microphone 54 is coupled to pins 130*a* and 130*b* such that the patient's voice signals are transmitted to the remote nurse's station 72 and its speaker 126. If both the nurse's audio signals are detected on channel 120 and the patient's audio signals are detected on channel 124, switch controller 104 may be configured in different manners according to different embodiments in order to determine the state of switch 102.

In one embodiment, if switch controller 104 simultaneously detects nurse audio signals on channel 120 at the same time it detects patient audio signals on channel 122, it maintains the current state of the switch 102 for a predetermined time (assuming audio continues to be detected on both channels 120 and 124), and then switches to the other state. In another embodiment, switch controller 104 always prioritizes the nurse's audio over the patient's audio and maintains switch 102 in the state that couples audio channel 120 to speaker 52 until the nurse stops talking. In another alternative embodiment, switch controller 104 always prioritizes the patient's audio over the nurse's audio and maintains switch 102 in the state that couples microphone 54 to channel 120 until the patient stops talking. Still other manners are possible of dealing with simultaneous nurse and patient talking, including, but not limited to, recording with delayed playback of one of the participant's audio signals after the other has stopped talking.

It will be understood that, in those embodiments of nurse call interface 98 that are adapted to detect whether audio signals on channel 120 are coming from TV 86 or from a nurse call microphone 136 positioned at nurse's station 72, switch controller 104 may be configured to always ignore the presence of TV audio signals on channel 120 when determining the state of switch 102. In other words, switch controller 104 may be configured to couple microphone 54 to channel 120 at the appropriate times, regardless of whether the TV audio is arriving at patient support apparatus 20 on channel 120 or not.

The detection of TV audio signals on nurse call audio channel 120 may also be used by switch controller 104 in order to determine when to change switch 102 from its second state to its first state. For example, if the patient places a call while he or she is watching TV 86, switch controller 104 may leave switch 102 in the second state (channel 120 coupled to speaker 52) so that the patient continues to hear the TV audio on speaker 52 until the nurse answers the call, which may not happen immediately. Once the nurse initially answers, the switch controller 104 may subsequently changes switch 102 to the first state to thereby allow the patient to speak into microphone 54 and have his or her voice signals transmitted to nurse's station 72.

It will be understood that a number of different modifications beyond those previously discussed can be made to switch controller 104 and/or nurse call interface 98. For example, in one embodiment, one or more isolation transformers are added to switch controller 104 in order to galvanically isolate the electrical components of patient support apparatus 20 from the electrical signals coming from nurse call outlet 88. In such embodiments, the isolation transformer(s) may specifically provide galvanic isolation to speaker 52 and microphone 54 from pins 130*a* and 130*b*. In addition, the audio signals on channels 120, 122, and/or 124 may be digitized at various points, and suitable digital-to-analog and analog-to-digital converters may be included in order to process this digitization.

Another modification is the use of a single microcontroller to implement the functions of both switch controller 104 and switch 102. Such a single microcontroller may digitally couple to channel 120 along a first set of I/O pins and digitally couple to channels 122 and 124 along a second (and, in some cases, a third) set of I/O pins. In such embodiments, the microcontroller determines whether channel 120 is to be communicatively coupled to channel 122 or channel 124, and then repeats the digitized inputs received at one set of I/O pins at the corresponding other set of I/O pins according to the desired directionality of the audio signals.

Another modification that may be made to nurse call interface 98 is the addition of one or more reverse polarity protection circuits, particularly for, but not limited to, pins 130*a* and 130*b*. Such reverse polarity protection circuits can be implemented in a number of different manners, including, but not limited to, circuits that utilize one or more bridge rectifiers. Such reverse polarity protection allows nurse call interface 98 to couple to different nurse call outlets 88 in which the nurse call system 68 switches the polarity of one or more pins. Still other modifications to switch controller 104, switch 102, and/or other aspects of nurse call interface 98 may be implemented.

It will be understood that nurse call outlet 88, cable 90, and cable port 100 are all illustrated in FIG. 5 as having only six pins. This is done merely for purposes of compact illustration. All of these components typically include 37 pins, although there are other nurse call outlets having different pin numbers and the principles of the present disclosure can be applied in healthcare facilities having these types of nurse call systems as well. The pins that are not shown in FIG. 5 are used by other components of patient support apparatus 20 for other purposes. For example, one pin may be used to convey information to nurse call system 68 and/or an intermediate structure along the path of conductor 92 (e.g. a room interface board 128) indicating whether the patient has pressed a control on patient support apparatus 20 to turn on or turn off a light in the particular room in which patient support apparatus 20 is located. Another pin may communicate that the exit detection system onboard patient support apparatus 20 has detected the patient exiting from patient support apparatus 20. Still others of the additional pins may be used to communicate any one or more of the following: whether one or more siderails 34 are in a down position (or an up position); whether the position of any of the siderails 34 changes from an initial state; whether a brake on patient support apparatus 20 is set; whether the exit detection system is armed; whether support deck 30 is at its lowest height; whether head section 40 has pivoted to less than a threshold angle (e.g. 30 degrees); and whether patient support apparatus 20 has been set or not to monitor a particular set of conditions. These various items of data are detected by one or more corresponding sensors onboard patient support apparatus 20 that are in communication with cable port 100. Still others of the additional pins may be used for still other purposes.

Figure 6:
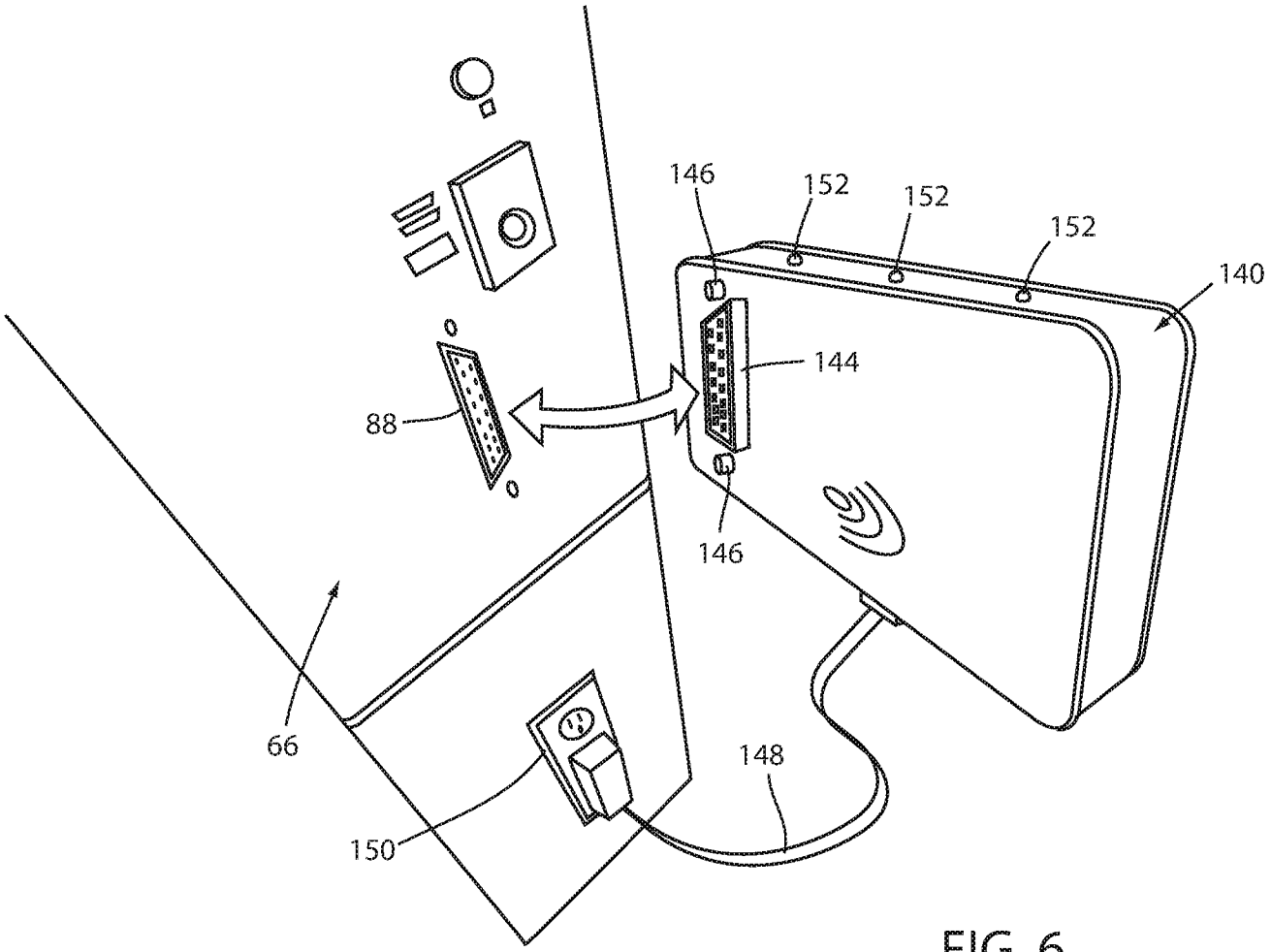
FIG. 6 is a perspective view of a first embodiment of a headwall module that incorporates a wireless nurse call interface according to another embodiment of the present disclosure.

FIG. 6 illustrates a headwall module 140 according to another embodiment of the present disclosure. Headwall module 140 is adapted to plug directly into nurse call outlet 88 and to wirelessly communicate with patient support apparatus 20. Headwall module 140 is further adapted to control whether the half duplex audio connection of the nurse call system (e.g. pins 130*a* and 130*b*) are communicatively coupled to the speaker 52 or the microphone 54 onboard patient support apparatus 20. Thus, headwall module 140 performs the same functions as nurse call interface 98, but does them while positioned on a headwall 66 of a healthcare facility room 70.

Headwall module 140 includes a connector 144 integrated therein that is adapted to directly couple to nurse call outlet 88. Connector 144 is thus shaped and dimensioned to be frictionally maintained in an electrically coupled state to outlet 88, and to support the entire headwall module 140. One or more alignment posts 146 may be included with connector 144 in order to more securely retain headwall module 140 to nurse call outlet 88, if desired.

In the embodiment shown in FIG. 6, connector 144 is a 37 pin connector that includes 37 pins adapted to be inserted into 37 mating sockets of nurse call outlet 88. As noted, such 37 pin connections are one of the most common types of connectors found on existing headwalls of medical facilities for making connections to the nurse call system 68. Such 37 pin connectors, however, are not the only type of connectors, and it will be understood that headwall module 140 can utilize different types of connectors 144 (whether integrated therein or attached to a cable) that are adapted to electrically couple to different types of nurse call outlet 88. One example of such an alternative nurse call outlet 88 and cable is disclosed in commonly assigned U.S. patent application Ser. No. 14/819,844 filed Aug. 6, 2015 by inventors Krishna Bhimavarapu et al. and entitled PATIENT SUPPORT APPARATUSES WITH WIRELESS HEADWALL COMMUNICATION, the complete disclosure of which is incorporated herein by reference. Still other types of nurse call outlets 88 and corresponding cable connectors 144 may be utilized.

In the embodiment shown in FIG. 6, headwall module 140 includes an electrical cable 148 having an end adapted to be inserted into a conventional electrical outlet 150. Electrical cable 148 enables headwall module 140 to receive power from the mains electrical supply via outlet 150. It will be appreciated that, in some embodiments, headwall module 140 is battery operated and cable 148 may be omitted. In still other embodiments, headwall module 140 may be both battery operated and include cable 148 so that in the event of a power failure, battery power supplies power to headwall module 140, and/or in the event of a battery failure, electrical power is received through outlet 150.

The embodiment of headwall module 140 shown in FIG. 6 also includes a plurality of status lights 152. Status lights 152 provide visual indications about one or more aspects of headwall module 140. For example, in some embodiments, the illumination of one of status lights 152 indicates that headwall module 140 is in successful communication with nurse call system 68 and/or patient support apparatus 20. The illumination of one or more additional status lights 152 may also or alternatively indicate that power is being supplied to headwall module 140 and/or the status of a battery included within headwall module 140. Still further, in some embodiments, one or more of status lights 152 may be illuminated depending upon whether a nurse is talking to the patient via pins 130*a* and 130*b*, or the patient is talking to the nurse via pins 130*a* and 130*b*.

Headwall module 140 (FIG. 6) is adapted to wirelessly receive signals from patient support apparatus 20 and deliver the signals to nurse call outlet 88 in a manner that matches the way the signals would otherwise be delivered to nurse call outlet 88 if a conventional nurse call cable (e.g. cable 90) were connected between patient support apparatus 20 and nurse call outlet 88. In other words, patient support apparatus 20 and headwall module 140 cooperate to provide signals to nurse call outlet 88 in a manner that is transparent to nurse call outlet 88 and nurse call system 68 such that these components cannot detect whether they are in communication with patient support apparatus 20 via wired or wireless communication. In this manner, a healthcare facility can utilize the wireless communication abilities of one or more patient support apparatuses 20 without having to make any changes to their existing nurse call outlet 88 or to their nurse call system 68.

In addition to sending signals received from patient support apparatus 20 to nurse call outlet 88, headwall module 140 is also adapted to forward signals received from nurse call outlet 88 to patient support apparatus 20. Headwall module 140 is therefore adapted to provide bidirectional communication between patient support apparatus 20 and nurse call outlet 88. Such bidirectional communication includes, but is not limited to, communicating audio signals between a person supported on patient support apparatus 20 and a nurse positioned remotely from patient support apparatus 20 (e.g. nurses' station 72). The audio signals received by headwall module 140 from patient support apparatus 20 are forwarded to nurse call outlet 88, and the audio signals received from nurse call outlet 88 are forwarded to patient support apparatus 20 in a manner controller by a switch controller 104*a* positioned inside of headwall module 140.

Headwall module 140 communicates the data and signals it receives from patient support apparatus 20 to the appropriate pins of nurse call outlet 88. Likewise, it communicates the data signals it receives and/or detects on the pins of nurse call outlet 88 to patient support apparatus 20 via wireless messages. The wireless messages include sufficient information for patient support apparatus 20 to discern what pins the messages originated from, or sufficient information for patient support apparatus 20 to decipher the information included in the message. In at least one embodiment, headwall module 140 includes any and/or all of the same functionality as the headwall unit 76 disclosed in commonly assigned U.S. patent application Ser. No. 16/215,911 filed Dec. 11, 2018, by inventors Alexander Bodurka et al. and entitled HOSPITAL HEADWALL COMMUNICATION SYSTEM, the complete disclosure of which is incorporated herein by reference. Alternatively, or additionally, headwall module 140 may include any and/or all of the same functionality as the headwall interface 38 disclosed in commonly assigned U.S. patent publication 2016/0038361 published Feb. 11, 2016, entitled PATIENT SUPPORT APPARATUSES WITH WIRELESS HEADWALL COMMUNICATION, and filed by inventors Krishna Bhimavarapu et al., the complete disclosure of which is also incorporated herein by reference.

Figure 7:
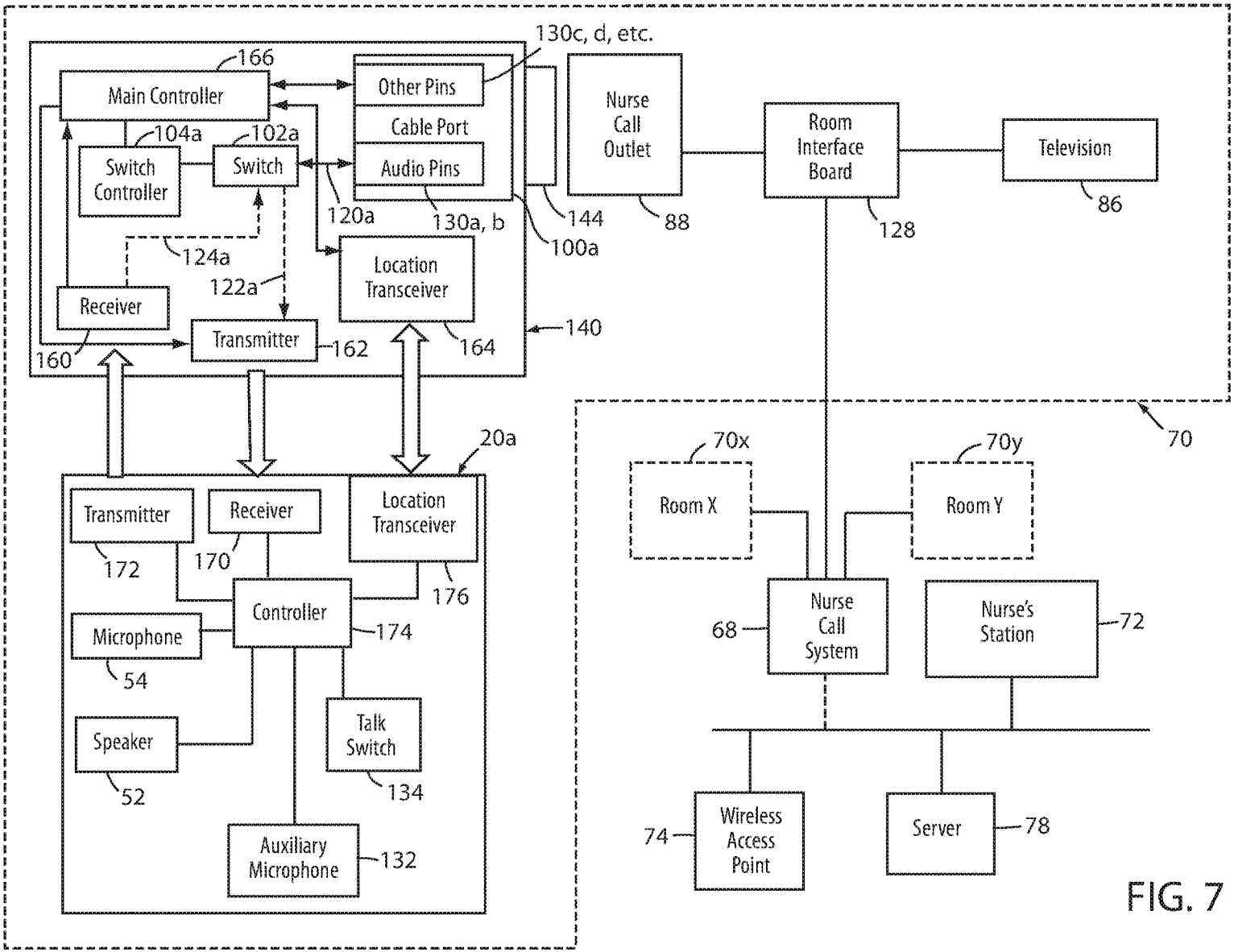
FIG. 7 is a diagram of the headwall module of FIG. 6, a patient support apparatus in communication with the headwall module, and various off-board components of a representative healthcare facility that are also in communication with the headwall module.

FIG. 7 provides a diagram of the internal components of headwall module 140, as well as the communication connections of headwall module 140 to nurse call system 68 and an adjacent patient support apparatus 20*a*. As shown therein, headwall module 140 includes a receiver 160, a transmitter 162, a location transceiver 164, and a main controller 166. Headwall module 140 further includes a switch 102*a*, a switch controller 104*a*, and a cable port 100*a*. Switch 102*a* may be the same as switch 102 of FIG. 5 except that it is located within headwall module 140, rather than patient support apparatus 20 of FIG. 5. Similarly, switch controller 104*a* and/or cable port 100*a* may be the same as switch controller 104 and cable port 100, respectively, of patient support apparatus 20 of FIG. 5, except for their being located within headwall module 140 rather than within a patient support apparatus.

Switch controller 104*a* controls whether a bed speaker channel 122*a* or a bed microphone channel 124*a* is communicatively coupled to a nurse call audio channel 120*a*. Bed speaker channel 122*a* is the same as bed speaker channel 122 of FIG. 5 except that the signals on bed speaker channel 122*a* are not forwarded to bed speaker 52 via a wired connection, but instead are first routed to wireless transmitter 162 which sends them wirelessly to a wireless receiver 170 positioned onboard patient support apparatus 20. Wireless receiver 170 passes these wireless signals to speaker 52, either directly, or through one or more intermediary structures, such as a controller 174.

Bed microphone channel 124*a* of headwall module 140 is the same as bed microphone channel 124 of FIG. 5 except that the signals that are fed to switch controller 104*a* along bed microphone channel 134*a* are received wirelessly from receiver 160, rather than from a wired connection directly coupled to microphone 54. Audio signals detected by microphone 54 are forwarded to controller 174 which routes them to wireless transmitter 172. Wireless transmitter 172 sends the audio signals to receiver 160 of headwall module 140. Both receiver 160 and transmitter 162 are part of a Bluetooth transceiver, in at least one embodiment.

After wireless receipt of the audio signals detected by microphone 54, receiver 160 then inputs them into switch 102*a* and to switch controller 104*a*. Switch controller 104*a* either then places switch 102*a* in a first state in which it couples bed microphone channel 124*a* to nurse call audio channel 120*a*, or it places switch 102*a* in a second state in which bed speaker channel 122*a* is coupled to nurse call audio channel 120*a*. Although not shown in FIG. 7, bed speaker channel 122*a* and bed microphone channel 124*a* may both be fed into switch controller 104*a*. More specifically, these two channels may be fed into audio analyzers within switch controller 104*a* that correspond to, and operate in any of the same manners as, audio analyzers 106 and 108, respectively, of the patient support apparatus 20 shown in FIG. 5. Alternatively, as with switch controller 104 of FIG. 5, switch controller 104*a* may omit one or both of these audio analyzers in different embodiments.

Non-audio signals that are received by headwall module 140 are routed through main controller 166, rather than switch controller 104*a*. Such non-audio signals include the signals on pins 130*c*, 130*d*, and the other pins of the nurse call outlet 88 (other than pins 130*a* and 130*b*). Signals on pins 130*c* and 130*d* are, in some embodiments, fed to switch controller 104*a* by main controller 166. That is, just as with switch controller 104, switch controller 104*a* may include a nurse call light input 110 and a nurse call answer light input 112. The signals for both of these inputs, when included, are provided by main controller 166, which reads the voltage values on these pins (130*c*, 130*d*) and provides them to switch controller 104*a*. Alternatively, the outputs from pins 130*c* and/or 130*d* may be provided directly to switch controller 104*a* without passing through main controller 166.

Switch controller 104*a* may further include an auxiliary microphone input 114 and/or a talk switch input 116. The signals for these inputs are delivered wirelessly from transmitter 172 of patient support apparatus 20 to receiver 160 of headwall module 140. From receiver 160, the signals are either fed directly to switch controller 104*a*, or are first processed by main controller 166 before being forwarded to switch controller 104*a*.

From the foregoing description, it can therefore be seen that switch controller 104*a* may operate in any of the same ways that were previously described above with respect to switch controller 104. The only differences are that switch controller 104*a* is positioned offboard patient support apparatus 20, and consequently the signals delivered on inputs 110, 112, 114, and/or 116 (as well as bed microphone channel 124*a*) arrive at headwall module 140 wirelessly, rather than by a wireless connection. Still further, the signals supplied to bed speaker channel 122*a* are also delivered wirelessly to patient support apparatus wirelessly. The remaining aspects of switch controller 104*a* of headwall module 140 are the same as switch controller 104 of FIG. 5, and therefore need not be described further.

As shown in FIG. 7, headwall module 140 includes a location transceiver 164. Location transceiver 164 is, in some embodiments, a short range transceiver that emits a short range signal containing a unique identifier. Patient support apparatus 20 includes a corresponding location transceiver 176 that is able to detect the short range signal from location transceiver 164 when the patient support apparatus 20 is positioned adjacent to headwall module 140 (e.g. within approximately a meter or two). Patient support apparatus 20 forwards this unique signal to an offboard server, such as server 78, which contains a table correlating the unique identifiers of each headwall module 140 to their location within the healthcare facility. Server 78 is therefore able to determine the location of each patient support apparatus 20 within the healthcare facility whenever the patient support apparatus 20 is positioned adjacent a headwall module 140. In some embodiments, both location transceivers 164 and 176 are infrared modules. Further explanation of one manner in which transceivers 164 and 176 may operate are provided in the following commonly assigned U.S. patent application Ser. No. 16/215,911 filed Dec. 11, 2018, by inventors Alexander Bodurka et al. and entitled HOSPITAL HEADWALL COMMUNICATION SYSTEM; Ser. No. 16/217,203 filed Dec. 12, 2018, by inventor Alexander Bodurka, and entitled SMART HOSPITAL HEADWALL SYSTEM; and Ser. No. 16/193,150 filed Nov. 16, 2018, by inventors Alexander Bodurka et al. and entitled PATIENT SUPPORT APPARATUSES WITH LOCATION/MOVEMENT DETECTION, the complete disclosures of all of which are incorporated herein by reference.

It will be understood that headwall module 140 may include any one or more of the additional circuits and/or modifications of nurse call interface 98 that were discussed above with respect to FIG. 5. These modifications and/or additions include, but are not limited to, the following: the addition of one or more amplifiers within headwall module 140 that amplify the signals on any one or more of nurse call audio channel 120*a*, bed speaker channel 122*a*, and/or bed microphone channel 124*a*; the addition of a reverse polarity protection circuit for pins 130*a*, 130*b* (and/or other pins) so that the headwall module 140 can be coupled to different nurse call outlets 88 that have the polarity of these two pins (and/or other pins) reversed; the addition of one or more analog-to-digital converters and/or digital-to-analog converters to change the form of the signals coming into, or exiting, headwall module 140; the addition of one or more isolation transformers that galvanically isolate one or more of the components of headwall module 140 from the pins of nurse call outlet 88; the combination of switch 102*a* and switch controller 104*a* into a single microcontroller that performs the functions of both of these components; and/or the addition or modification of one or more other components.

It will also be understood that patient support apparatus 20*a* of FIG. 7 may be modified to include a nurse call interface 98 that is the same as the nurse call interface 98 incorporated into patient support apparatus 20 (FIG. 5). Such a modification allows patient support apparatus 20 to communicate with the nurse call system either wirelessly (using headwall module 140, transmitter 172, and receiver 170) or by a wired connection (e.g. a cable 90 plugged into the onboard nurse call interface 98). By including structures that allow the modified patient support apparatus 20 to communicate either wirelessly or by a cable 90, the patient support apparatus 20 can be used in different healthcare facilities and/or different areas within the same healthcare facility, some of which may include wireless headwall modules 140 and some of which may not. Still other modifications may be made to patient support apparatus 20 and/or 20*a*.

Figure 8:
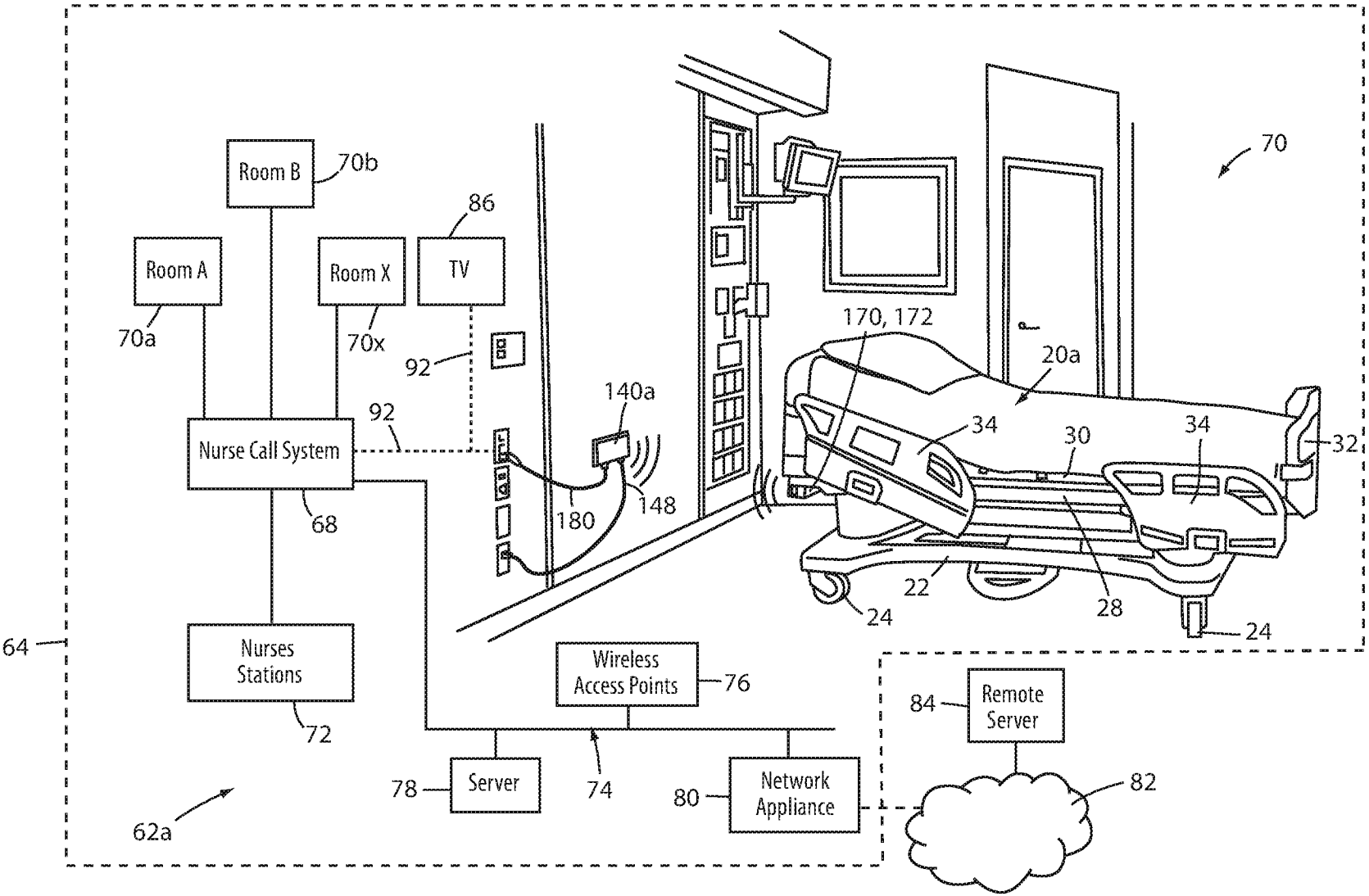
FIG. 8 is a diagram of the patient support apparatus of FIG. 8 and an alternative headwall module, both of which are communicatively coupled to the IT infrastructure of a representative healthcare facility.

FIG. 8 illustrates a patient support apparatus 20*a* coupled to an alternative headwall module 140*a*. Headwall module 140*a* differs from headwall module 140 of FIG. 7 in that, instead of a connector 144 built into its body for coupling to nurse call outlet 88, headwall module 140*a* includes a cable 180 that couples headwall module 140*a* to nurse call outlet 88. Cable 180 provides the same functionality as connector 144 and, in some embodiments, may be the same as cable 90. Headwall module 140*a* provides a location advantage over headwall module 140 in that it may be located at a different position on headwall 66 than the position at which nurse call outlet 88 is located. This may better enable headwall module 140*a* to be positioned at a location that aligns with, or is otherwise within sufficiently close proximity to, location transceiver 176 of patient support apparatus 20*a*. Headwall module 140*a* operates in any of the same manners as headwall module 140 discussed above.

Figure 9:
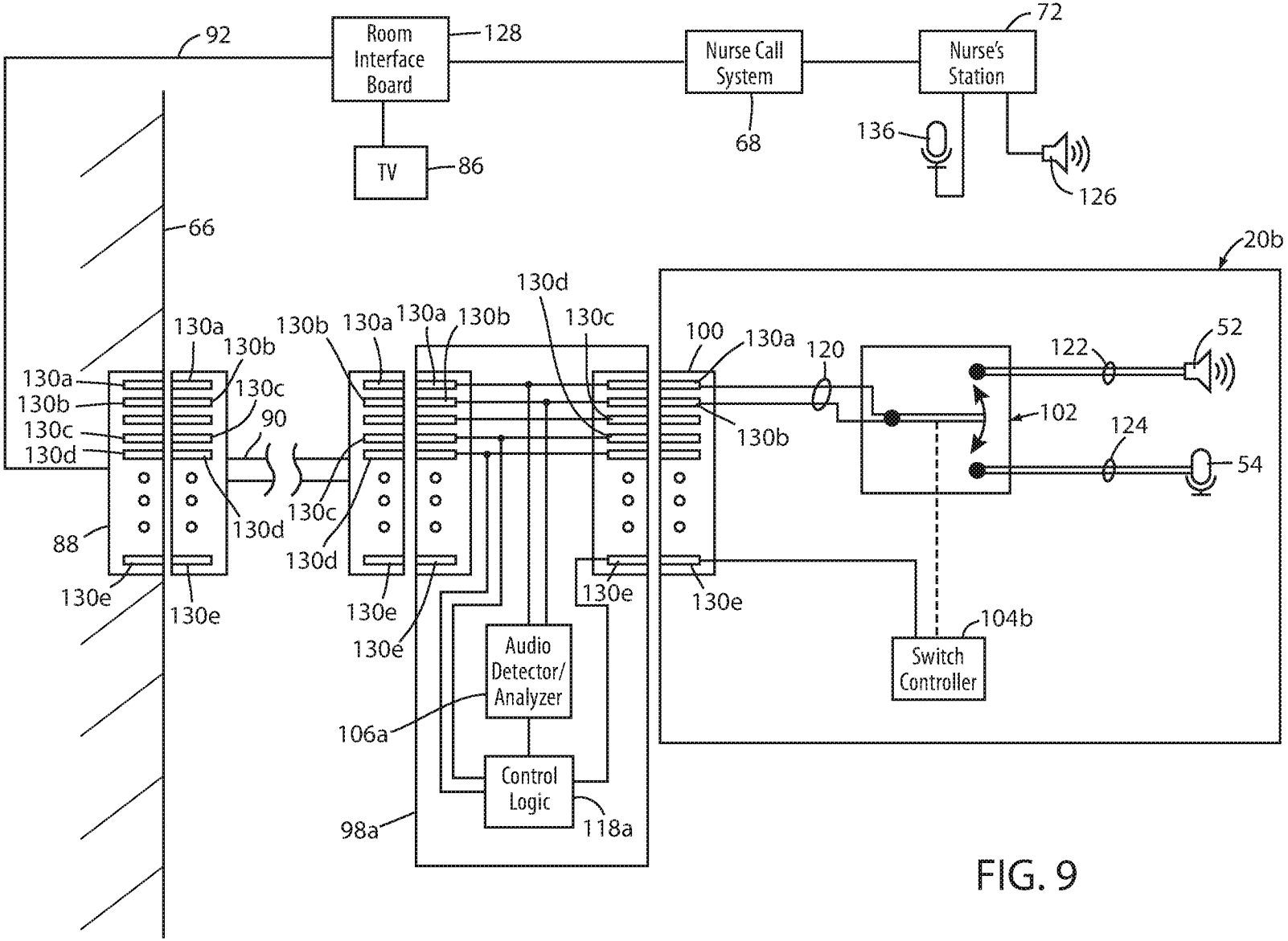
FIG. 9 is a diagram of a standalone nurse call interface adapted to be coupled between a patient support apparatus and a nurse call cable according to another embodiment of the present disclosure.

FIG. 9 illustrates a standalone nurse call interface 98*a* that is adapted to provide similar functionality as nurse call interface 98 of FIG. 5. Standalone nurse call interface 98*a* is adapted to be inserted between cable 90 and patient support apparatus 20*b*. In the embodiment shown in FIG. 9, standalone nurse call interface 98*a* is positioned between patient support apparatus 20 and cable 90, but it will be understood that standalone nurse call interface 98*a* could alternatively be positioned between cable 90 and nurse call outlet 88.

Those components of FIG. 9 that are the same as corresponding components of FIG. 5 have been provided with the same reference numbers and, unless otherwise explicitly stated herein, operate in the same manners previously described. Those components of FIG. 9 that are similar to components of FIG. 5, but have some differences, are labeled with the same number followed by a letter that distinguishes them from the components of FIG. 5 (or FIG.

7). Those components of FIG. 9 that are not found in previous drawings have been assigned a new number and operate in the manner described below.

As can be seen from a comparison of FIG. 9 to FIG. 5, patient support apparatus 20*b* of FIG. 9 is different from patient support apparatus 20 of FIG. 5 in that it does not include nurse call interface 98. Instead, it includes cable port 100, a modified switch controller 104*b*, and switch 102. Switch controller 104*b* controls the state of switch 102 based upon a signal it detects on a pin 130*e*. Pin 130*e* is a pin that is typically not used by nurse call systems 68. However, standalone nurse call interface 98*a* uses pin 130*e* to communicate when switch controller 104*b* is to put switch 102 in the first state and when it is to put switch 102 in the second state. In some embodiments, pin 130*e* may correspond to the audio transfer plus pin (pin 9) of FIG. 12, although it will be understood that other pins may be used. In general, however, switch controller 104*b* utilizes whatever signal standalone nurse call interface 98*a* places on pin 130*e* to control the state of switch 102.

In one embodiment, standalone nurse call interface 98*a* uses the outputs from pins 130*c* and 130*d*, which correspond to the nurse call light and nurse call answer light pins, respectively, to instruct switch controller 104*b* (via pin 130*e*) as to what state to put switch 102 in. Thus, for example, when the nurse answers the patient call, the nurse call answer light pin (pin 130*d*) will change its state, and control logic 118*a* uses this change in state to output a signal on pin 130*e* that switch controller 104*b* uses to put switch 102 in the second state (i.e. nurse call audio channel 120 is coupled to speaker 52). When the nurse call answer light pin 130*d* changes back to a state indicating that the nurse is not speaking, control logic 118*a* sends a signal on pin 130*e* instructing switch controller 104*b* to change back to the first state. Control logic 118*a* may utilize the outputs from an audio analyzer 106*a* that operates in any of the same manners described above with respect to audio analyzer 106 when deciding how to instruct switch controller 104*b*. Standalone nurse call interface 98*a* therefore allows a patient support apparatus, such as patient support apparatus 20*b*, to include both a separate speaker 52 and separate microphone 54 and communicate with a half duplex nurse call system, yet not require all of the built-in circuitry of the nurse call interface 98 of FIG. 6.

Any of the nurse call interfaces 98, 98 and/or headwall modules 140, 140*a* discussed herein may be modified in a number of additional manners. As but one example, any of these structures may be modified to undergo an initial installation test in which the signal on pin 130*d* is monitored to see if it changes when the nurse answers the patient's phone call. In some nurse call system, pin 130*d* does not change in response to a nurse answering the patient's call. By monitoring the signal on pin 130*d* during an initial test in which a remotely positioned nurse answers a call, the corresponding switch controller (104, 104*a* etc.) is able to determine if the signal on pin 130*d* is a reliable factor or not for controlling its corresponding switch 102, 102*a*, 102*b*, etc. If it determines it is not a reliable factor for controlling the switch, then it modifies its control logic 118, 118*a*, etc. accordingly and uses other information to control the state of switch 102 (e.g. information from inputs 110, 114, 116, and/or audio analyzers 106, 108). If it determines it is a reliable factor, it defines the control logic 118, 118*a*, etc. so that it utilizes the signals from pin 130*d*. Thus, switch controllers 104, 104*a*, etc. may be modified such that their corresponding control logic 118, 118*a*, etc. automatically adapts to the configuration of an existing nurse call system based on the results of an initial testing of that nurse call system. Similar testing may be performed for other pins of the nurse call outlet 88, such as, but not limited to, an audio transfer pin (e.g. pins 8 and/or 9 in FIG. 12).

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A bed comprising:

a litter frame;

a support deck supported by the litter frame, the support deck adapted to support a patient thereon;

a lift system adapted to change a height of the litter frame relative to a floor on which the bed is positioned;

a speaker;

a nurse call interface adapted to interface between the bed and a wall-mounted nurse call outlet having a plurality of pins, the nurse call interface adapted allow a patient supported on the support deck to communicate with a remotely positioned nurse, the nurse call interface including:

a nurse call audio channel communicatively coupled to first and second audio pins of the plurality of pins of the nurse call outlet; and a television audio detector in communication with the nurse call audio channel, the television audio detector adapted to distinguish between television audio signals and nurse call audio signals that are present on the nurse call audio channel, the television audio signals coming from a television and the nurse call audio signals coming from a nurse call microphone positioned adjacent the remotely positioned nurse.

2. The bed of claim 1 wherein the television audio detector is adapted to distinguish between television audio signals and nurse call audio signals that are present on the nurse call audio channel by sending a mute signal to the television and monitoring any change in signals present on the nurse call audio channel.

3. The bed of claim 1 further comprising a microphone, and wherein the nurse call interface further comprises:

a bed microphone channel communicatively coupled to the microphone;

a bed speaker channel communicatively coupled to the speaker;

a switch adapted to switch between a first state in which the nurse call audio channel is communicatively coupled to the bed microphone channel and a second state in which the nurse call audio channel is communicatively coupled to the bed speaker channel; and a switch controller adapted to control when the switch is in the first state and when the switch is in the second state.

4. The bed of claim 3 wherein the switch controller includes a nurse call light input, the nurse call light input adapted to communicate with a nurse call light pin from the plurality of pins of the nurse call outlet, and wherein the switch controller uses a signal from the nurse call light input to control when to put the switch in the first state or the second state.

5. The bed of claim 3 wherein the switch controller includes a nurse call answer light input, the nurse call answer light input adapted to communicate with a nurse call answer light pin from the plurality of pins of the nurse call outlet, and wherein the switch controller uses a signal from the nurse call answer light input to control when to put the switch in the first state or the second state.

6. The bed of claim 3 further comprising a talk switch, the talk switch adapted to be activated by the patient when the patient wishes to talk to the remotely positioned nurse, wherein the talk switch is in communication with the switch controller and the switch controller is adapted to use a signal from the talk switch to control when to put the switch in the first state or the second state, and wherein the talk switch is a button adapted to be pressed when the patient wishes to talk to the remotely positioned nurse.

7. The bed of claim 3 wherein the switch controller is adapted to analyze a signal on the bed microphone channel and to use the analysis of the signal to control when to put the switch in the first state or the second state, and wherein the analysis of the signal on the bed microphone channel includes removing any component of the signal due to sounds emitted from the speaker and captured by the microphone as well as detecting an audio signal from the patient, and wherein the switch controller is further adapted to change the switch to the first state if the switch controller detects the audio signal from the patient on the bed microphone channel and to change the switch to the second state if the switch controller does not detect an audio signal from the patient on the bed microphone channel.

8. The bed of claim 3 wherein the nurse call interface further comprises a first audio detector adapted to detect a first audio signal on the nurse call audio channel and a second audio detector adapted to detect a second audio signal on the bed microphone channel, wherein the switch controller uses a first signal from the first audio detector and a second signal from the second audio detector to control when to put the switch in the first state or the second state, and wherein the switch controller is further configured to set the switch to the first state when both the first audio detector detects the first audio signal on the nurse call audio channel and the second audio detector detects the second audio signal on the bed microphone channel.

9. The bed of claim 3 wherein the switch controller is further adapted to perform the following:

monitor a state of a particular pin from the plurality of pins during an installation test in which the remotely positioned nurse transmits an audio signal to the nurse call audio channel, the particular pin being different from both the first and second audio pins; and if the particular pin changes state during the installation test, to use the state of the particular pin subsequent to the installation test to control when the switch is in the first state and when the switch is in the second state; and if the particular pin does not change state during the installation test, to not use the state of the particular pin subsequent to the installation test to control when the switch is in the first state and when the switch is in the second state; wherein the particular pin is a nurse call answer light pin.

10. The bed of claim 9 wherein the switch controller is further adapted to monitor a state of a second particular pin during the installation test and, if the state of the second particular pin changes state during the installation test, to use the state of the second particular pin to control when the switch is in the first state and when the switch is in the second state, and if the second particular pin does not change state during the installation test, to not use the state of the second particular pin to control when the switch is in the first state and when the switch is in the second state; wherein the second particular pin is an audio transfer pin.

11. A wireless nurse call interface adapted to be mounted to a wall and to provide an interface between a bed and a wall-mounted nurse call outlet having a plurality of pins to thereby allow a patient supported on the bed to communicate with a remotely positioned nurse, the wireless nurse call interface comprising:

a nurse call audio channel communicatively coupled to first and second audio pins of the plurality of pins of the nurse call outlet;

a bed microphone channel communicatively coupled to a wireless receiver, the wireless receiver adapted to receive audio signals from the bed that are generated by a bed microphone;

a bed speaker channel communicatively coupled to a wireless transmitter, the wireless transmitter adapted to transmit audio signals to the bed to be communicated to a bed speaker; and a television audio detector in communication with the nurse call audio channel, the television audio detector adapted to distinguish between television audio signals and nurse call audio signals that are present on the nurse call audio channel, the television audio signals coming from a television and the nurse call audio signals coming from a nurse call microphone positioned adjacent the remotely positioned nurse.

12. The wireless nurse call interface of claim 11 wherein the television audio detector is adapted to distinguish between television audio signals and nurse call audio signals that are present on the nurse call audio channel by sending a mute signal to the television and monitoring any change in signals present on the nurse call audio channel.

13. The wireless nurse call interface of claim 11 further comprising:

a switch adapted to switch between a first state in which the nurse call audio channel is communicatively coupled to the bed microphone channel and a second state in which the nurse call audio channel is communicatively coupled to the bed speaker channel; and a switch controller adapted to control when the switch is in the first state and when the switch is in the second state.

14. The wireless nurse call interface of claim 13 wherein the switch controller includes at least one of a nurse call light input or a nurse call answer light input, the nurse call light input adapted to communicate with a nurse call light pin from the plurality of pins of the nurse call outlet and the nurse call answer light input adapted to communicate with a nurse call answer light pin from the plurality of pins of the nurse call outlet, and wherein the switch controller uses at least one of signal from the nurse call light input or a signal from the nurse call answer light input to control when to put the switch in the first state or the second state.

15. The wireless nurse call interface of claim 13 wherein the wireless receiver is further adapted to receive a wireless signal from a talk switch coupled to the bed, the talk switch adapted to be activated by the patient when the patient wishes to talk to the remotely positioned nurse, wherein the switch controller uses the wireless signal from the talk switch to control when to put the switch in the first state or the second state, and wherein the talk switch is a button adapted to be pressed when the patient wishes to talk to the remotely positioned nurse.

16. The wireless nurse call interface of claim 13 wherein the switch controller is adapted to analyze a signal on the bed microphone channel and to use the analysis of the signal to control when to put the switch in the first state or the second state, wherein the analyzing of the signal on the bed microphone channel includes removing any component of the signal due to sounds emitted from the bed speaker and captured by the bed microphone, and wherein the analysis of the signal on the bed microphone channel also includes detecting an audio signal from the patient, and the switch controller is adapted to change the switch to the first state if the switch controller detects the audio signal from the patient on the bed microphone channel and to change the switch to the second state if the switch controller does not detect the audio signal from the patient on the bed microphone channel.

17. The wireless nurse call interface claim 13 wherein the switch controller is adapted to set the switch to the first state when the switch controller detects a signal on the bed microphone channel to thereby add the signal on the bed microphone channel to the nurse call audio channel.

18. The wireless nurse call interface claim 13 further comprising a first audio detector adapted to detect a first audio signal on the nurse call audio channel and a second audio detector adapted to detect a second audio signal on the bed microphone channel, wherein the switch controller uses a first signal from the first audio detector and a second signal from the second audio detector to control when to put the switch in the first state or the second state, and wherein the switch controller is further configured to set the switch to the first state when both the first audio detector detects the first audio signal on the nurse call audio channel and the second audio detector detects the second audio signal on the bed microphone channel.

19. The wireless nurse call interface of claim 13 wherein the switch controller is further adapted to perform the following:

monitor a state of a particular pin from the plurality of pins during an installation test in which the remotely positioned nurse transmits an audio signal to the nurse call audio channel, the particular pin being different from both the first and second audio pins; and if the particular pin changes state during the installation test, to use the state of the particular pin subsequent to the installation test to control when the switch is in the first state and when the switch is in the second state; and if the particular pin does not change state during the installation test, to not use the state of the particular pin subsequent to the installation test to control when the switch is in the first state and when the switch is in the second state; wherein the particular pin is a nurse call answer light pin.

20. The wireless nurse call interface of claim 19 wherein the switch controller is further adapted to monitor a state of a second particular pin during the installation test and, if the state of the second particular pin changes state during the installation test, to use the state of the second particular pin to control when the switch is in the first state and when the switch is in the second state, and if the second particular pin does not change state during the installation test, to not use the state of the second particular pin to control when the switch is in the first state and when the switch is in the second state, wherein the second particular pin is an audio transfer pin.

* * * * *